US008904915B2

(12) United States Patent
Howland

(10) Patent No.: US 8,904,915 B2
(45) Date of Patent: Dec. 9, 2014

(54) THERMALLY VENTED BODY ARMOR

(75) Inventor: Charles A Howland, Temple, NH (US)

(73) Assignee: Warwick Mills, Inc., New Ipswich, NH (US)

( * ) Notice: Subject to any disclaimer, the term of this patent is extended or adjusted under 35 U.S.C. 154(b) by 547 days.

(21) Appl. No.: 13/256,475

(22) PCT Filed: Mar. 19, 2010

(86) PCT No.: PCT/US2010/028035
§ 371 (c)(1),
(2), (4) Date: Sep. 14, 2011

(87) PCT Pub. No.: WO2010/108133
PCT Pub. Date: Sep. 23, 2010

(65) Prior Publication Data

US 2012/0159680 A1 Jun. 28, 2012

Related U.S. Application Data

(60) Provisional application No. 61/162,017, filed on Mar. 20, 2009.

(51) Int. Cl.
*F41H 5/08* (2006.01)
*F41H 5/04* (2006.01)
*F41H 1/02* (2006.01)

(52) U.S. Cl.
CPC ..... *F41H 1/02* (2013.01); *F41H 5/0471* (2013.01); *F41H 5/0492* (2013.01)
USPC ..... 89/36.05; 89/921

(58) Field of Classification Search
USPC ..... 89/36.05, 36.01, 36.02, 921, 917; 2/2.5; 428/911
See application file for complete search history.

(56) References Cited

U.S. PATENT DOCUMENTS 1,574,188 A 2/1926 Friedman
1,739,112 A * 12/1929 Wisbrod ..... 2/2.5
(Continued)

FOREIGN PATENT DOCUMENTS

EP 0933612 A2 8/1999
EP 0967453 A1 12/1999
(Continued)

OTHER PUBLICATIONS

PCT Search Report and Written Opinion for PCT Application No. PCT/US2011/031658, Feb. 8, 2012,14 pages.
(Continued)

*Primary Examiner* — Reginald Tillman, Jr.
(74) *Attorney, Agent, or Firm* — Maine Cernota & Rardin

(57) ABSTRACT

A modular and field adaptable body armor system includes a plurality of flexible, air-permeable, thermally vented plates arranged in fixed relationships that provide flexible, modular, field-adaptable protection for the torso and extremities without excessive weight or heat burden. The TVA plates include protective cards suspended in a parallel, louvered relationship between inner and outer mesh layers, thereby permitting air to flow therebetween while providing a flexible, compressible, modular barrier that protects the torso and extremities against projectiles. In embodiments, the outer mesh layer resists penetration and compresses cards together to intercept a projectile that would otherwise pass therebetween. Protective cards can include thermally pressed and flexed laminated UHMWPE. TVA panels can be removed and exchanged in the field according to the requirements of each mission. In embodiments, the TVA plates are laced together and/or attached to an underlying fabric carrier garment.

43 Claims, 18 Drawing Sheets

(56) References Cited

U.S. PATENT DOCUMENTS

| | | | | |
|---|---|---|---|---|
| 2,771,384 | A | 11/1956 | Collins | |
| 2,942,327 | A | 6/1960 | Corry | |
| 3,061,839 | A | 11/1962 | Foster | |
| 3,130,414 | A | 4/1964 | Bailey et al. | |
| 3,392,406 | A * | 7/1968 | Pernini et al. | 2/2.5 |
| 3,509,833 | A | 5/1970 | Cook | |
| 3,683,828 | A | 8/1972 | Alliegro et al. | |
| 3,826,172 | A | 7/1974 | Dawson | |
| 3,945,042 | A | 3/1976 | Lobo | |
| 4,090,011 | A | 5/1978 | Barkman et al. | |
| 4,198,707 | A | 4/1980 | Haupt et al. | |
| 2,640,987 | A | 6/1983 | Ehlers | |
| 4,559,251 | A | 12/1985 | Wachi | |
| 4,574,105 | A | 3/1986 | Donovan | |
| 4,660,223 | A | 4/1987 | Fritch | |
| 4,911,061 | A | 3/1990 | Pivett et al. | |
| 5,102,723 | A | 4/1992 | Pepin | |
| 5,175,040 | A | 12/1992 | Harpell et al. | |
| 5,185,195 | A | 2/1993 | Harpell et al. | |
| 5,191,166 | A | 3/1993 | Smirlock et al. | |
| 5,196,252 | A | 3/1993 | Harpell | |
| 5,198,280 | A | 3/1993 | Harpell et al. | |
| 5,254,383 | A | 10/1993 | Harpell et al. | |
| 5,326,249 | A | 7/1994 | Wiessfloch | |
| 5,361,678 | A | 11/1994 | Roopchand et al. | |
| 5,362,527 | A | 11/1994 | Harpell et al. | |
| 5,364,679 | A | 11/1994 | Groves | |
| 5,565,264 | A | 10/1996 | Howland | |
| 5,591,933 | A | 1/1997 | Li et al. | |
| 5,601,895 | A | 2/1997 | Cunningham | |
| 5,619,748 | A | 4/1997 | Nelson et al. | |
| 5,668,344 | A | 9/1997 | Bornstein | |
| 5,677,029 | A | 10/1997 | Prevorsek et al. | |
| 5,723,201 | A | 3/1998 | Czetto, Jr. | |
| 5,824,940 | A | 10/1998 | Chediak et al. | |
| 5,827,608 | A | 10/1998 | Rinehart et al. | |
| 5,837,623 | A | 11/1998 | Howland | |
| 5,853,547 | A | 12/1998 | Aherns et al. | |
| 5,882,357 | A | 3/1999 | Sun et al. | |
| 5,891,379 | A | 4/1999 | Bhattacharyya et al. | |
| 5,976,996 | A | 11/1999 | Howland | |
| 6,035,438 | A | 3/2000 | Neal et al. | |
| 6,077,319 | A | 6/2000 | Sun et al. | |
| 6,266,818 | B1 | 7/2001 | Howland et al. | |
| 6,332,390 | B1 | 12/2001 | Lyons | |
| 6,510,777 | B2 | 1/2003 | Neal | |
| 6,534,426 | B1 | 3/2003 | Chiou | |
| 6,543,055 | B2 | 4/2003 | Howland et al. | |
| 6,548,430 | B1 | 4/2003 | Howland | |
| 6,612,217 | B1 | 9/2003 | Shockey et al. | |
| 6,627,562 | B1 | 9/2003 | Gehring, Jr. | |
| 6,668,868 | B2 | 12/2003 | Howland et al. | |
| 6,693,052 | B2 | 2/2004 | Howland | |
| 6,720,277 | B1 | 4/2004 | Howland | |
| 6,743,498 | B2 | 6/2004 | Fourmeux | |
| 6,770,287 | B1 | 8/2004 | Sun et al. | |
| 6,834,685 | B2 | 12/2004 | Hannigan et al. | |
| 6,840,288 | B2 | 1/2005 | Zhu et al. | |
| 6,911,247 | B2 | 6/2005 | Howland | |
| 6,997,218 | B1 * | 2/2006 | Garcia et al. | 141/98 |
| 6,998,165 | B2 | 2/2006 | Howland | |
| 7,007,308 | B1 | 3/2006 | Howland et al. | |
| 7,115,315 | B2 | 10/2006 | Fowler | |
| 7,192,498 | B2 | 3/2007 | Howland | |
| 7,393,588 | B1 | 7/2008 | Howland | |
| 8,069,494 | B2 * | 12/2011 | Sundnes | 2/2.5 |
| 2001/0053645 | A1 | 12/2001 | Henderson | |
| 2002/0069444 | A1 | 6/2002 | Graham et al. | |
| 2002/0106956 | A1 | 8/2002 | Howland | |
| 2002/0111099 | A1 | 8/2002 | Howland | |
| 2002/0122927 | A1 | 9/2002 | Howland | |
| 2002/0124904 | A1 | 9/2002 | Howland et al. | |
| 2003/0159575 | A1 | 8/2003 | Reichman | |
| 2003/0228815 | A1 | 12/2003 | Bhatnagar et al. | |
| 2004/0092183 | A1 | 5/2004 | Geva et al. | |
| 2005/0118716 | A1 | 6/2005 | Howland et al. | |
| 2005/0197024 | A1 | 9/2005 | Howland | |
| 2005/0255776 | A1 | 11/2005 | Howland | |
| 2005/0288797 | A1 | 12/2005 | Howland | |
| 2006/0005305 | A1 | 1/2006 | Haskell | |
| 2006/0014457 | A1 | 1/2006 | Newton et al. | |
| 2006/0068158 | A1 | 3/2006 | Howland | |
| 2007/0016996 | A1 | 1/2007 | Seitzinger et al. | |
| 2007/0054817 | A1 | 3/2007 | Li et al. | |
| 2007/0099526 | A1 | 5/2007 | Heerden et al. | |
| 2007/0238379 | A1 | 10/2007 | Bhatnagar et al. | |
| 2008/0032084 | A1 | 2/2008 | Biermann et al. | |
| 2008/0087161 | A1 | 4/2008 | Dean et al. | |
| 2008/0104735 | A1 | 5/2008 | Howland | |
| 2008/0160855 | A1 | 7/2008 | Howland | |
| 2009/0255022 | A1 | 10/2009 | Smith | |
| 2009/0293711 | A1 | 12/2009 | Altergott et al. | |
| 2012/0152098 | A1 | 6/2012 | Howland et al. | |
| 2012/0159680 | A1 | 6/2012 | Howland | |

FOREIGN PATENT DOCUMENTS

| | | | |
|---|---|---|---|
| GB | 2004177 | A | 3/1979 |
| KR | 1020100004357 | A | 1/2010 |
| WO | 9220520 | A1 | 11/1992 |
| WO | 0033013 | | 6/2000 |
| WO | 0210667 | A2 | 2/2002 |
| WO | 03057462 | A1 | 7/2003 |
| WO | 2005044559 | | 5/2005 |
| WO | 2008048301 | A2 | 4/2008 |

OTHER PUBLICATIONS

Anderson,Charles E., Long-Rod Penetration, Target Resistance, and Hypervelocity Impact, Int. J. Impact Engng vol. 14, No. 1-4, 1993, pp. 1-12 (12 pgs).

Walker, James, A Time-Dependent Model for Long-Rod Penetration, Int. J. Impact Engng vol. 16, No. 1, pp. 19-48, 1995, (30 pgs).

Anderson, Charles E., An Examination of Long-Rod Penetration, Int. J. Impact Engng vol. 11, No. 4, 1991, pp. 481-501 (21 pgs).

European Search Report for EP Application No. 08870614, Nov. 19, 2012, 6 pgs.

European Search Report for EP Application No. 07868256.4, Oct. 24, 2012, 6 pgs.

PCT Search Report for PCT Application No. PCT/US2008-081688, Jun. 16, 2009,1 page.

Anderson, Charles E. Jr., et al., "On the Hydrodynamic Approximation for Long-Rod Penetration", International Journal of Impact Engineering, 1999, pp. 23-43 (21 pgs), vol. 22.

Kleponis, David S., et al., Material Design Paradigms for Optimal Functional Gradient Armors, Mar. 13, 2000, 6 pages.

European Examination Report for EP Application No. 01994286.1, dated Oct. 1, 2007, 7 pgs.

European Examination Report for EP Application No. 01994286.1, dated May 15, 2009, 3 pgs.

European Examination Report for EP Application No. 01994286.1, dated Aug. 16, 2010, 4 pgs.

European Examination Report for EP Application No. 04796627.0, Jul. 13, 2010, 8 pgs.

European Examination Report for EP Application No. 04796627.0, Mar. 28, 2011, 7 pgs.

European Search Report for EP Application No. 05724858, Mar. 25, 2010.

European Supplementary Partial Search Report for EP Application No. 01994286, dated Jan. 10, 2005, 4 pgs.

PCT Search Report dated Aug. 22, 2008 of Patent Application No. PCT/US07/67878 filed May 1, 2007, 1 pg.

PCT International Search Report dated Jun. 28, 2002 of International Appl. No. PCT/US01/48947 filed Dec. 13, 2001.

European Search Report for EP Application No. 04796627.0, Mar. 15, 2010, 4 pages.

PCT Search Report for App. No. PCT/US04/35784, dated Mar. 7, 2005.

PCT Search Report for PCT Application No. PCT/US2005/07402, Aug. 7, 2006,1 page.

* cited by examiner

THERMALLY VENTED BODY ARMOR

RELATED APPLICATIONS

This application is a national phase application of PCT application No. PCT/US2010/028035, filed on Mar. 19, 2010, which claims the benefit of U.S. Provisional Application No. 61/162,017, filed on Mar. 20, 2009. Both of these applications are herein incorporated herein by reference in their entirety for all purposes.

GOVERNMENT INTEREST

The United States Government may have an interest in this invention with respect to Department of Defense—Office of Naval Research contract no. N00014-07-C-0494.

FIELD OF INVENTION

The invention relates to body armor, and in particular to body armor materials and systems that are suitable for dismounted infantry.

BACKGROUND

The current paradigm for military armor development goes roughly in the following steps. A requirement that defines ballistic-performance and coverage-area is established based on current needs in the field. The requirement comes back to the military hardware design community, and a carrier-garment and a ballistic-package are designed to fulfill the requirement. At this point interactions with other armor components and load carriage are resolved as best as can be arranged. If the garment solution gets through a wear trial process, then the garment and the ballistic-package can be fielded.

However, in the meantime the situation in the field has evolved. The original operational needs that established the basis for the armor requirement have now changed, and the field wants a new combination of ballistic protection and coverage-area.

This is a dilemma. Conflicts and tactics evolve too quickly for the armor development community to keep up with operational changes.

In addition, body armor requirements can change from mission to mission. An armor system that is acceptable for one mission, might be unacceptable for another. If an armor system is not suitable for a given mission, a soldier is faced with the choice of endangering his or her life by wearing the armor and thereby reducing his or her ability to perform the mission effectively, or endangering his or her life by not wearing the armor at all, and thereby being more vulnerable to enemy ballistic threats.

What is clearly needed, therefore, is a protective armor system that is field-adaptable to varying missions and threats. This implies an armor system that is modular, whereby various portions of the armor can be exchanged or simply removed so as to adjust the protection level, weight, thermal burden, and flexibility according to the immediate needs of each conflict and each mission. However, the creation of a practical, modular, field-adaptable armor system has proven difficult to achieve, especially for dismounted soldiers, for whom it is highly critical to limit weight and thermal burden, and to maintain maximum flexibility and mobility.

The task of designing modular, field-adaptable armor is even more difficult when protection of the extremities is required. For example, Improvised Explosive Devices (IEDs) are tactical and strategic insurgent weapons which exact a tremendous toll on warfighters. Unlike heads and torsos, dismounted warfighter arms and legs are typically not armored, and are therefore are vulnerable to a complex range of blast trauma injuries (debris, Packed Metal Projectiles, fragments, overpressure, burns, and acceleration-related joint/tissue damage) which result in significant morbidity and mortality. A lightweight, flexible extremity protection for IEDs and other fragmentation munitions suitable for use by a dismounted soldier has not existed.

Currently, there are add-on components for shoulder and side protection which augment the basic vest area protection of bodyarmor. While not strictly extremities, they represent an effort to increase the area of protective coverage. However, these solutions have not been extended to full extremity protection due to the concerns noted above.

An extremity protection solution called the QuadGuard System® (Applicant makes no claim to the trademark) was developed for Humvee turret gunners. This system weighs approximately 0.85 lbs/ft$^2$ (122 oz/yd$^2$). Another turret gunner blast protection strategy called the Cupola Protective Ensemble was adopted by modification of the Explosive Ordinance Disposal (EOD) counter-mine suit. For these vehicle-mounted applications, an active cooling vest fed from an on-vehicle chiller can be provided so as to avoid heat-stress.

However, while these systems are suitable for use by a mounted turret gunner, who does not require mobility beyond seated operation of the turret gun, none of these solutions is a viable candidate for dismounted infantry, due to their mass and/or thermal burden.

The carry loads for modern infantry and tactical operations are so high that additional extremity protection is only used in a very limited set of circumstances. In addition, the currently available extremity gear can only be used for approximately 30 minutes, because the thermal burden is so high that core body temperatures begin to exceed safe levels after this time. In general, the current approach to extremity protection is to model the extremity protective panels after the fabric panels found in the ballistic vest. This approach leads to a weight of 0.5-1 lb/ft$^2$ (72-144 oz/yd$^2$). Panels of this type do not permit heat transfer and produce a Total Heat Loss result of less than 150 watts/m$^2$ of covered area. Experience has shown that this low rate of heat loss has a strong tendency to cause heat stress.

The task of designing modular, field-adaptable armor is made even more difficult by the conventional wisdom in the art that requires protection only in the central region of a panel. The issue comes from the interpretation of effective or TESTED area density. In existing test methods, generally the "Fair-Shot" placement excludes a 2" border around the edge of a tested panel. For a 10 inch by 12 inch panel, this leaves only 40% of the area in the Fair-Shot zone, and the problem gets worse as the panel sizes get smaller.

This is one reason why exiting armor systems typically include only a few large panels, and it is yet another reason why extremity armor solutions are so difficult to design, due to the very small sizes of the required panels. Flexible, fabric-based "soft" panels in particular tend to degrade and unravel over time near their edges, and would require significant overlap of modules if included in a modular armor system. Ceramic and metal panels, on the other hand, can perform well near their edges. However, they are cumbersome to join without a gap in protection, and the rigidity of such panels prevents them from being joined in a fixed relationship, because the result of such an approach would be a rigid garment that would be unacceptable to a mobile, dismounted infantry soldier. A garment constructed from rigid modules that included extremity protection would also be very heavy, and would be nearly impossible for a soldier to put on or to take off without assistance due to its weight and rigidity.

A body armor system is therefore needed which provides continuous protection for extremities as well as for the torso and head, and which is modular, field-adaptable, flexible, lightweight, and breathable, thereby meeting the needs of dismounted infantry soldiers in evolving combat environments.

SUMMARY OF THE INVENTION

The invention, simply stated, is a modular, field-adaptable body armor system that is constructed from breathable mesh layers and "Thermal Vented Armor" ("TVA") panels which are flexible, breathable, and lightweight, which provide uniform protection over their entire area, and which can be provided in almost any size and shape. Each TVA panel includes a plurality of equally spaced protective cards arranged in a louvered fashion that provides a continuous, vented, flexible, protective barrier. Inner and outer breathable mesh layers are included, whereby the protective cards are located between the mesh layers. In some embodiments, the protective cards are attached to one or both of the mesh layers by card edges. In other embodiments, one or both of the mesh layers is a mesh garment which is not attached to the individual protective cards, but which simply overlies or underlies the assembled TVA panels when the body armor system is worn. In general, a plurality of underlying and/or overlying mesh garments can be included. For example, a whole-body armor system can include underlying and overlying mesh shirts, as well as underlying and overlying mesh pants.

The protective cards can have various widths and heights, allowing TVA panels of various shapes to be created. In embodiments, the cards are made from a material that provides protection substantially to the edges of the cards, thereby providing continuous protection while minimizing the required overlap of the cards.

In various embodiments, the protective cards are made from layers of hot-pressed ultra-high-molecular-weight polyethylene (UHMWPE). UHMWPE provides excellent ballistic protection in a low weight system. Some embodiments provide a TVA panel weight of less than 1.25 pounds per square inch. In embodiments, the UHMWPE layers are bonded together using a hot press method, which consists of a hot cycle and a cold cycle, both utilizing pressure. The UHMWPE is then flexed after molding, so as to form "hinge lines" that provide flexibility. (Applicant's U.S. patent application Ser. No. 12/261,211, filed Oct. 30, 2008, is hereby incorporated in its entirety by reference, for all purposes.) The bonded UHMWPE cards remain rigid between the hinge lines, and thereby provide protection to their edges without any tendency to degrade or unravel at the edges. The result is protective cards that provide protection and edge-performance typical of a rigid material, while at the same time providing a flexibility that would be more typical of a "soft" woven material.

The mesh layers are constructed of protective fibers assembled in an open weave pattern that permits airflow, and the intermediate layer includes a uniformly distributed array of protective cards suspended therebetween in a parallel, spaced-apart relationship that provides continuous protection for at least some projectile approach directions while permitting airflow between the protective cards.

The protective cards are suspended at a selected common angle between normal and parallel to the inner and outer layers, so that they present an overlapping layer of protection from some strike angles and an apparent gap of vulnerability between adjacent cards at other strike angles. However, in various embodiments the impact of a projectile against the outer mesh causes the proximate cards to flex and deflect toward each other, thereby closing the gap between the cards and providing protection for substantially all projectile approach directions.

In some embodiments the protective cards included of the present invention are selected and/or configured so as to provide continuous protection substantially to their edges, thereby limiting the degree of overlap that is required between the protective cards, and minimizing excess weight due to protective card overlap. This is a radical departure from conventional wisdom in the art of body armor, which teaches that an armor plate or assembly need not provide protection near its edges. In fact, current armor testing protocols require testing only of central regions of armor plates and assemblies, and specifically exclude testing of edge regions. Fabric-based armor solutions in particular, while light in weight, tend to degrade and unravel near their edges. Metal plates provide better protection near their edges, but are rigid, heavy, and do not breathe.

The TVA panels of the present invention are assembled with the inner and outer mesh layers so as to form the complete armor system. In some embodiments the TVA panels are attached to an underlying carrier garment such as a mesh "shirt carrier" using snaps, hook-and-loop, laces, or other attachment mechanisms known in the art. So as to simplify the terminology used to describe the relative placement of the TVA panels and the methods of joining the TVA panels, it will be assumed, for semantic purposes only, that the panels are oriented such that the inner and outer mesh layers are vertical, and the protective cards are tipped away from a vertical orientation about parallel, horizontal axes. However, it will be understood that the panels can, in fact, take on any desired orientation. Using this terminology, in various embodiments, TVA panels are arranged vertically by adjacently locating them in a fixed relationship so as to continue the overlapping, louvered arrangement of the protective cards.

TVA panels are positioned horizontally in a fixed relationship. In embodiments, continuous protection is provided between horizontally adjoining panels. In some of these embodiments, the TVA panels are arranged such that the protective panels are aligned and at least slightly overlapping. In other of these embodiments, separate joint-covering strips of louvered, protective cards are used to cover the junctures between horizontally adjoining TVA panels. In various embodiments, inner and/or outer mesh layers to which the TVA panels are attached are laced together so as to fix the relative positioning of horizontally and/or vertically adjacent TVA panels.

TVA panels of different shapes and sizes are combined in this manner as needed so as to conform the body armor approximately to the shape of the wearer's torso and extremities. The flexibility of the protective cards, and therefore of the TVA panels, enables them to be joined in fixed relation to each other so that continuous protection is provided with minimum wasted mass. Larger TVA panels are used to form front, back, and side torso sections, while extremities are protected by joining smaller TVA panels into appropriately sized, flexible sections that cover arms, legs, and such like.

DEFINITIONS

A mesh is defined herein to be any knitted, woven, or knotted fabric with an open texture. Also included in the definition of "mesh" is any material which is made of a substance which is formed so as to yield an open texture. The term "open texture" is defined herein to be any texture that consists of 25% or greater open area based on the surface area of material. A mesh may consist of lenos as needed, or of any other method of locking the fibers in an attempt to improve mesh mechanical stability.

A protective card is defined herein as a flat, usually but not necessarily rectangular-shaped panel of material which provides substantially uniform protection over its entire surface. Protective cards can be made of any material used for protection from any threat. In various embodiments, the protective cards are able to withstand a strike without penetration by a typical 2, 4, 16, 64 grain fragment-simulating projectile traveling at a speed of from 700 to 1000 feet per second. And in some embodiments the protective cards perform at National Institute of Justice "NIJ" level 3a. Protective card size is dependent on location and density of placement within the garment, because some overlap is required to provide continuous protection. In general, protective card sizes are a compromise between thermal performance and mass. Protective cards for arm and leg protection are typically sized with a largest dimension of between two and three inches, but may be larger or smaller in either or both dimensions.

DETAILED DESCRIPTION OF THE INVENTION

Figure 1A:
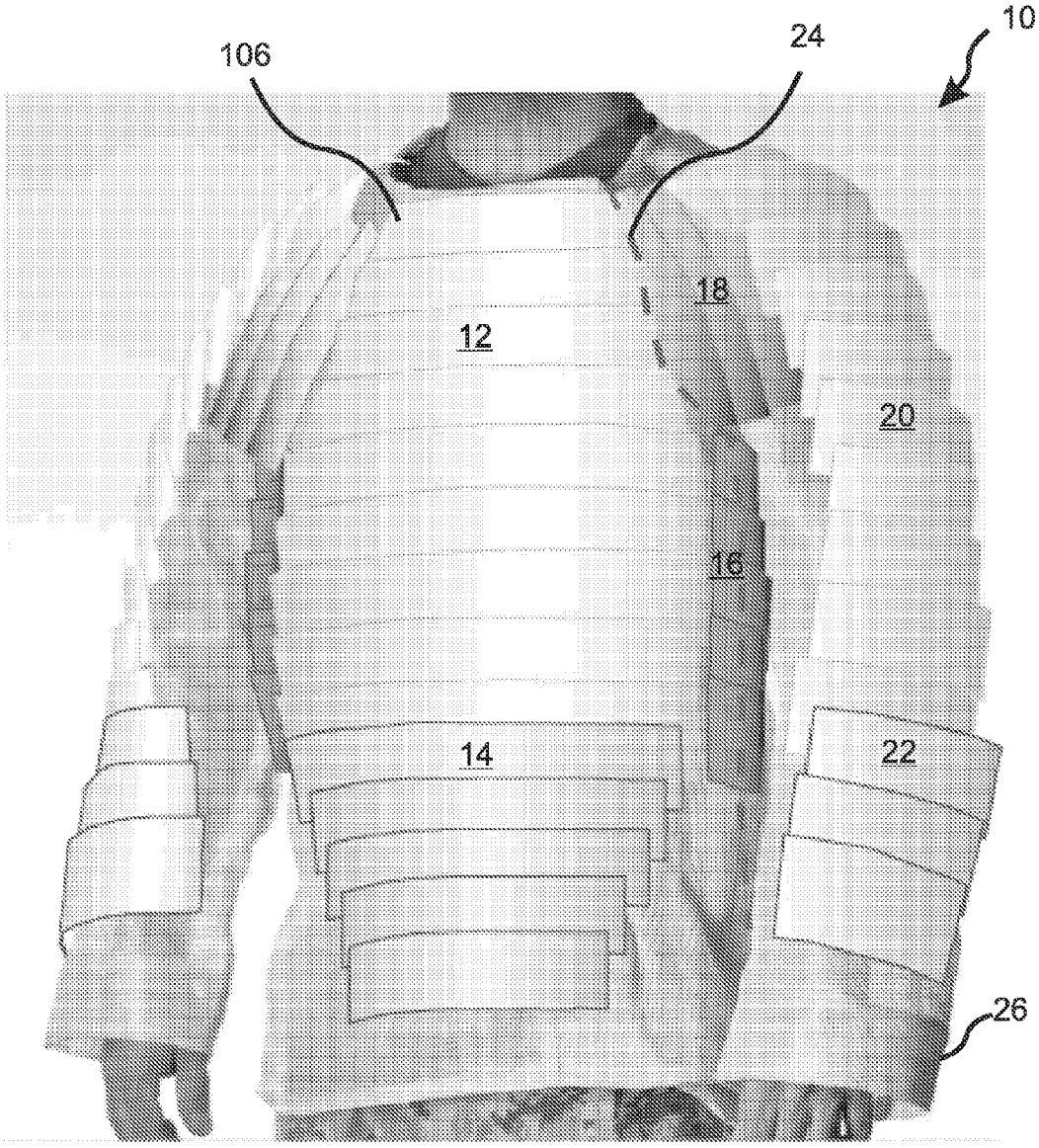
FIG. 1A is a perspective view of a soldier wearing a fully assembled embodiment of the present invention, wherein a plurality of TVA panels are attached to a mesh shirt carrier worn under the panels.

With reference to FIG. 1A, the present invention combines "Thermal Vented Armor" ("TVA") panels 12, 14, 16, 18, 20, 22 of various sizes and shapes so as to form a complete, modular, field-configurable protective armor system 10. In the embodiment of FIG. 1A, the TVA panels 12, 14, 16, 18, 20, 22 cover the upper chest 12, lower chest 14, lower side 16, upper side 18, upper arms 20, and lower arms 22. An openable closure 24 is provided as part of the assembled armor system, so as to enable a user to readily put the armor on and take it off without assistance, including the extremity protection sections 20, 22.

Note that in the embodiment of FIG. 1A the protective cards 106 of the TVA panels 12, 14, 16, 18, 20, 22 are not individually attached to mesh layers. Instead, they are assembled into the TVA panels 12, 14, 16, 18, 20, 22 by sewing, attachment to mesh strips, and/or by other means known in the art. In the illustrated embodiment, hook-and-loop attachment strips are used to attach the TVA panels 12, 14, 16, 18, 20, 22 to the inner mesh layer 26, which functions as a shirt carrier 26. The outer mesh layer is provided by a separate outer mesh shirt (30 in FIG. 1G) which is worn over the TVA panels 12, 14, 16, 18, 20, 22. In this embodiment, the shirt carrier 26 and outer mesh shirt provide additional ballistic protection to the user, so that no mass is wasted.

Figure 1B:
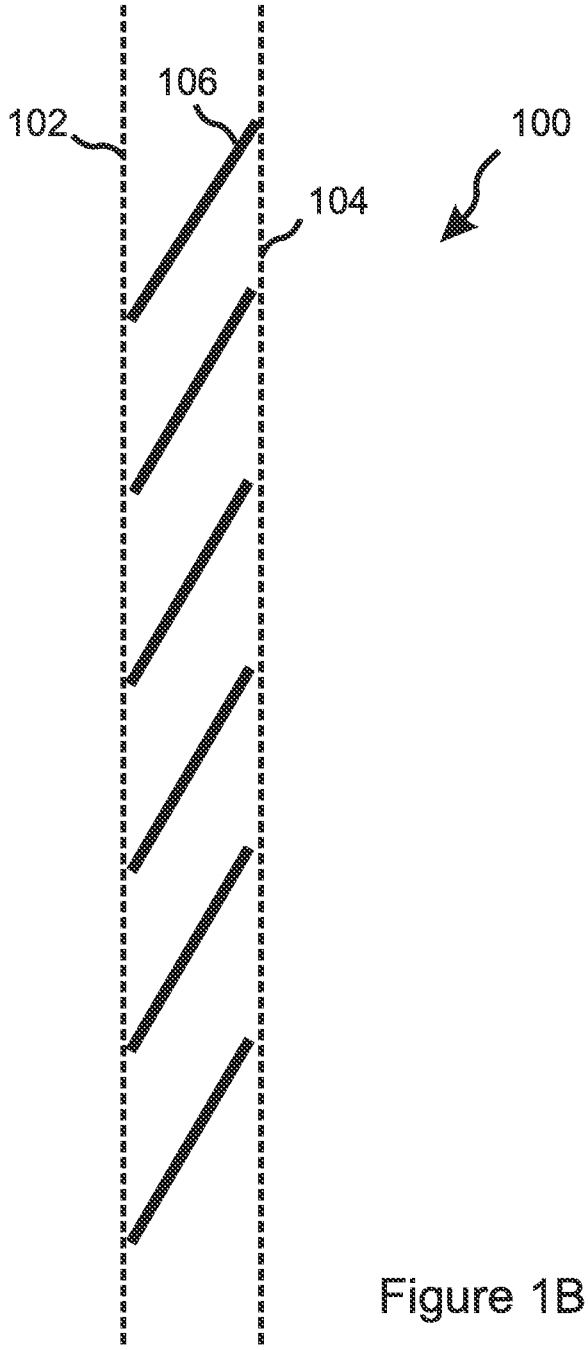
FIG. 1B is a cross-sectional view of a TVA panel of the embodiment of FIG. 1A.

With reference to FIG. 1B, each TVA panel 100 includes a plurality of equally spaced protective cards 106 which are arranged in a louvered fashion so as to provide a continuous, vented, flexible, protective barrier with enhanced protection against threats such as various Improvised Explosive Devices (IED's), while at the same time providing light weight and excellent flexibility and thermal management, so as to provide enhanced comfort to the user. In various embodiments the TVA panels have a mass of less than 1.25 pounds per square inch. When assembled into a body armor system, the TVA panels are surrounded by an outer mesh layer 102 and an inner mesh layer 104. Each of the TVA panels 100 is at least attached to one of the mesh layers 102, 104, so as to fix them in their relative positioning. In some embodiments, the protective cards themselves are attached by card edges to one or both of the mesh layers 102, 104.

The TVA panels 12, 14, 16, 18, 20, 22 are modular, and can be removed and/or exchanged in the field as needed according to varying threats and according to the requirements of each mission. In various embodiments, replacement TVA panels of varying weights and configurations are provided. When assembled, the TVA panels 12, 14, 16, 18, 20, 22 are substantially fixed in their relative positions by lacing, snaps, hook-and-loop, and/or by any other means well known in the art. In the embodiment of FIG. 1A, the panels are attached to and supported by a fabric "shirt carrier" 26 which is worn beneath the TVA panels. In similar embodiments, the TVA panels are attached to an outer mesh garment.

Figure 1C:
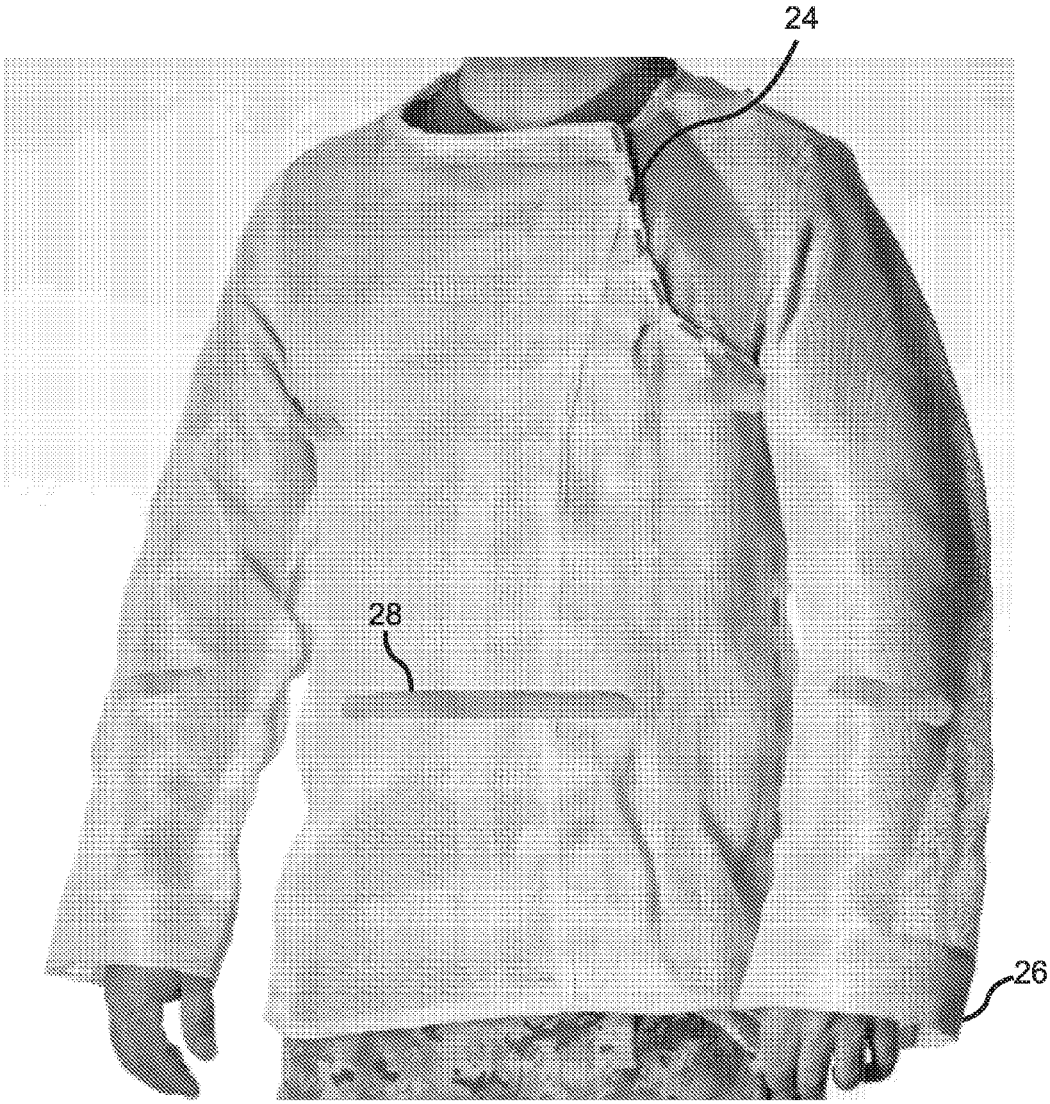
FIG. 1C is a perspective view of the soldier of FIG. 1A wearing only the mesh shirt carrier.

FIG. 1C is a perspective view of a soldier wearing the mesh shirt carrier 26 of FIG. 1A without any attached TVA panels. In this embodiment, the shirt carrier 26 functions as the inner mesh layer 104, and is made from 1500 denier Para Aramid or Vectran mesh, which offers some protection against IED's. Hook-and-loop strips 28 are provided at appropriate locations on the shirt carrier for attachment of the TVA panels. Note that in embodiments the mesh layers themselves provide significant protection against projectiles, so that all of the mass of the body armor system contributes to protection of the user.

Figure 1D:
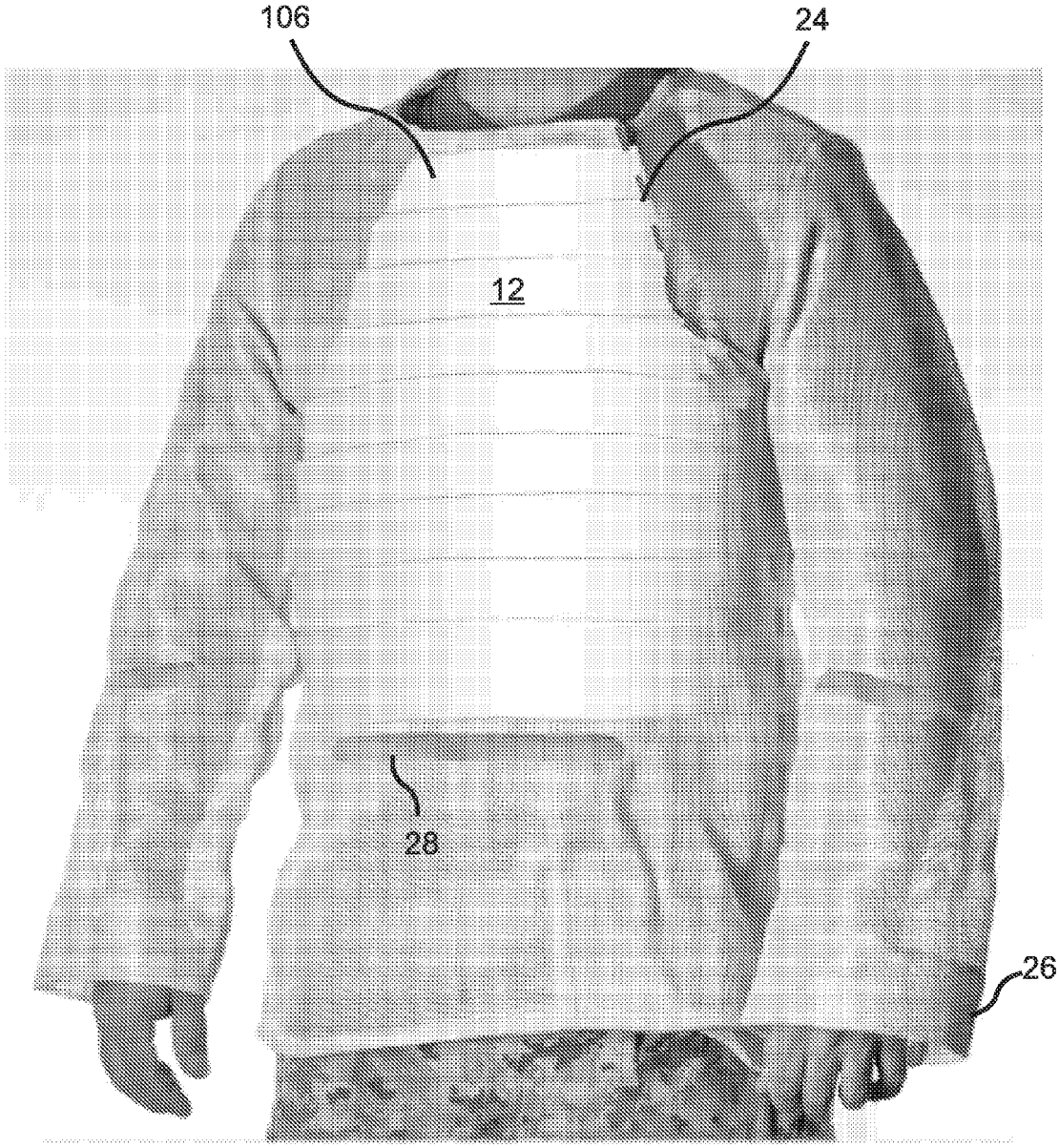
FIG. 1D is a perspective view of the soldier of FIG. 1C wearing only front and back upper torso TVA panels attached to the shirt carrier.

FIG. 1D is a perspective view of the soldier of FIG. 1C wherein only the upper front and back torso TVA panels 12 have been attached.

Figure 1E:
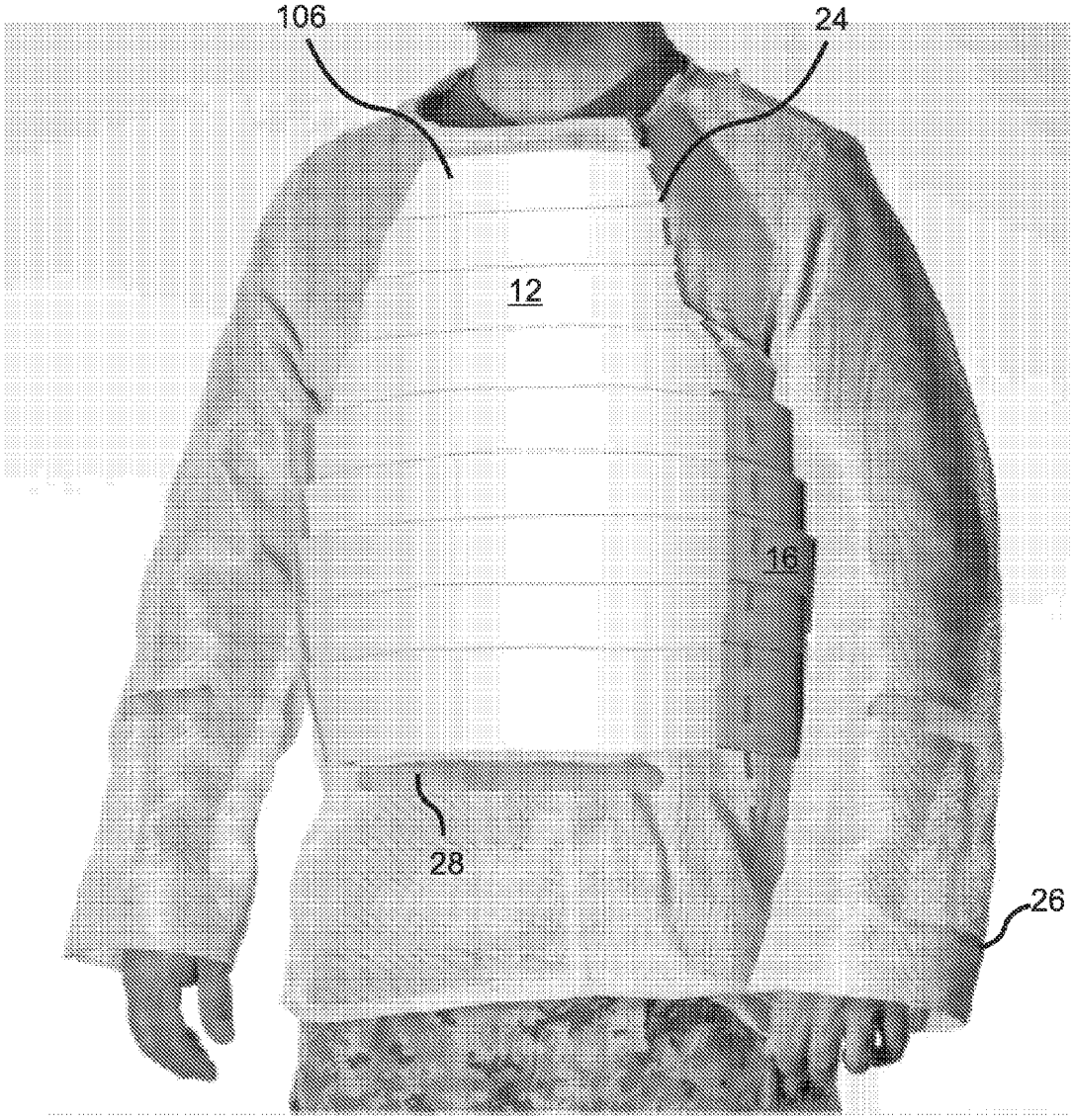
FIG. 1E is a perspective view of the soldier of FIG. 1D wearing front and back upper torso and lower side TVA panels attached to the shirt carrier.

FIG. 1E is a perspective view of the soldier of FIG. 1D wherein the upper front and back torso TVA panels 12 and the lower side TVA panels 16 have been attached. In some embodiments, adjoining TVA panels are laced together, as discussed in more detail below with regard to FIGS. 6A, 6B, and 7. In other embodiments, they are attached to each other by snaps, hook-and-loop, and/or other attachment mechanisms known in the art. In still other embodiments, the TVA panels rely on their attachment to a carrier garment 26 so as to maintain their relative positioning.

Figure 1F:
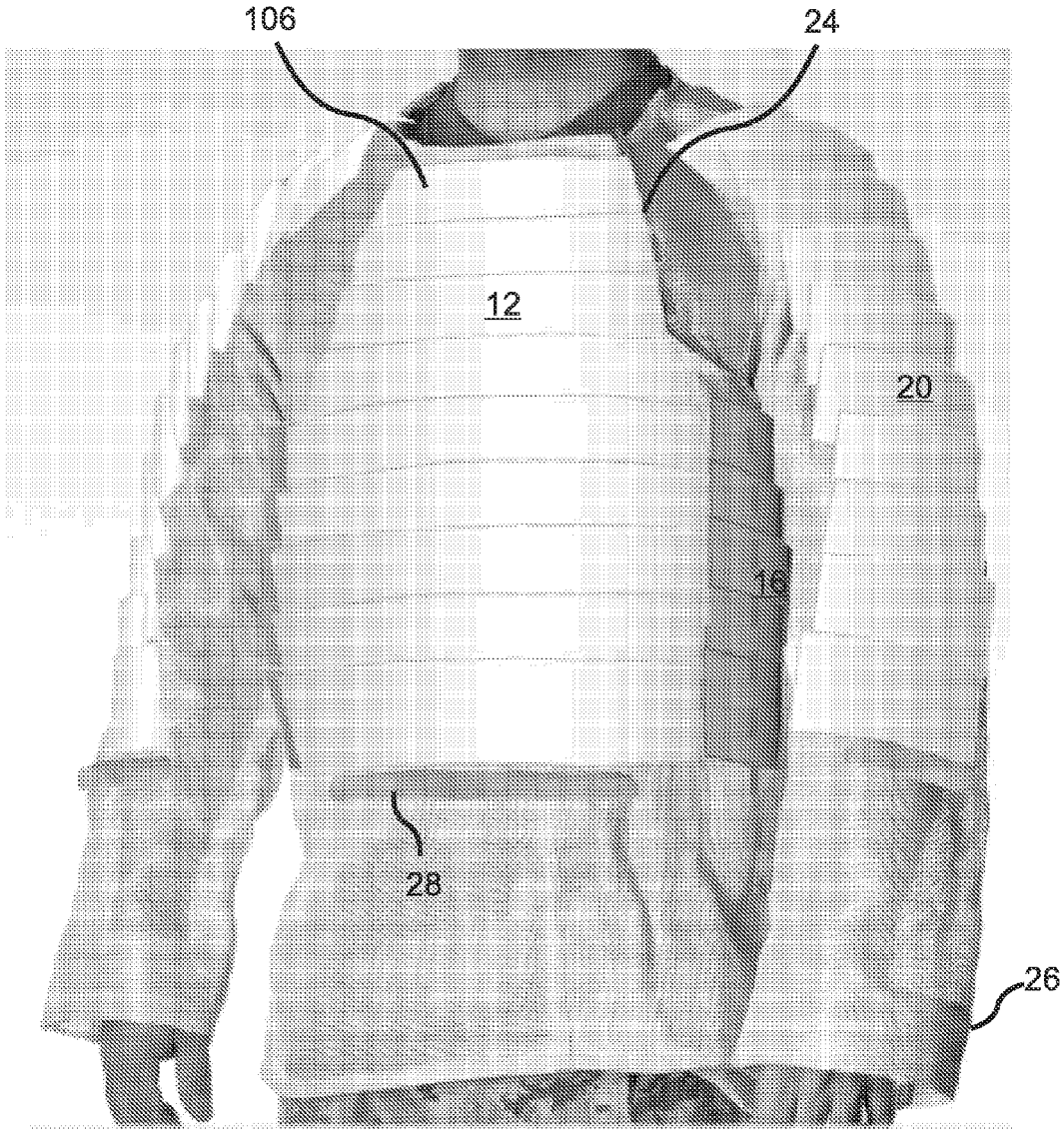
FIG. 1F is a perspective view of the soldier of FIG. 1E wearing front and back upper torso, lower side, and upper arm TVA panels attached to the shirt carrier.

FIG. 1F is a perspective view of the soldier of FIG. 1E wherein the upper front and back torso TVA panels 12, the lower side TVA panels 16, and the upper arm TVA panels 20 have been attached to the carrier shirt 26. The protective cards 106 of the arm TVA panels 20 are shorter in width than the protective cards 106 included in the upper torso TVA panel. The inherent flexibility of the louvered card configuration provides considerable freedom of movement in the direction of the louvers, for example when the soldier bends his or her elbows, or compresses his or her torso by bending forward at the waste. In some embodiments the protective cards in the arm TVA panels 20 are shorter in height than the protective cards 106 in the upper torso TVA panel 12, thereby increasing the flexibility of the arm TVA panels 20 even further. In addition, the flexibility of the UHMWPE protective cards themselves allows the TVA panels to press against each other and flex perpendicular to the louver direction so as to permit greater freedom of movement when, for example, the soldier twists at the waist.

Figure 1G:
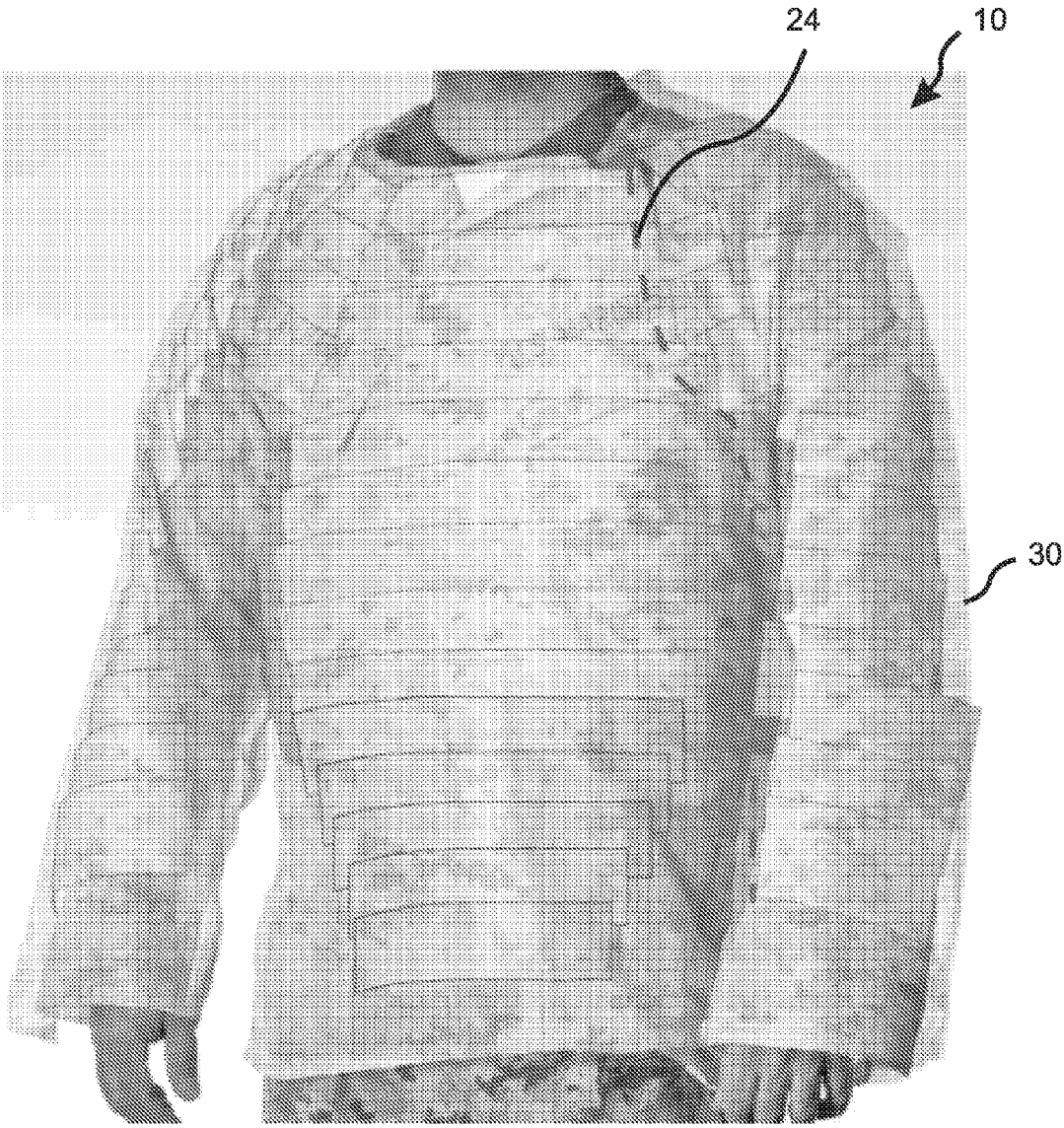
FIG. 1G is a perspective view of the soldier of FIG. 1F wearing a mesh outer garment over the body armor system of FIG. 1A.

FIG. 1G is a perspective view of the soldier of FIG. 1A, wherein the soldier is wearing an outer mesh garment 30 over the TVA armor system 10.

Inner and Outer Mesh Layers

With reference again to FIG. 1B, in certain embodiments the inner 102 and outer 104 mesh layers of each TVA panel 100 are both made from woven para aramid yarn. Para aramid fiber has good ballistic performance and is also inherently resistant to flame. Other ballistic fibers (UHMWPE, Vectran, PBO, etc) with greater than 20 grams per denier tenacity can be used, but must be treated to provide flame resistance. The mesh fabric in various embodiments is based on a plain weave construction, a leno looper construction, or a warp knit construction, all of which result in an open mesh with various levels of stabilization from loopers and main yarn crossing points. In some embodiments the para aramid yarn size is greater than 1000 denier, and in some of these embodiments the para aramid yarn size is greater than 1500 denier. This provides for a tough and snag-resistant mesh shell fabric.

Figure 2:
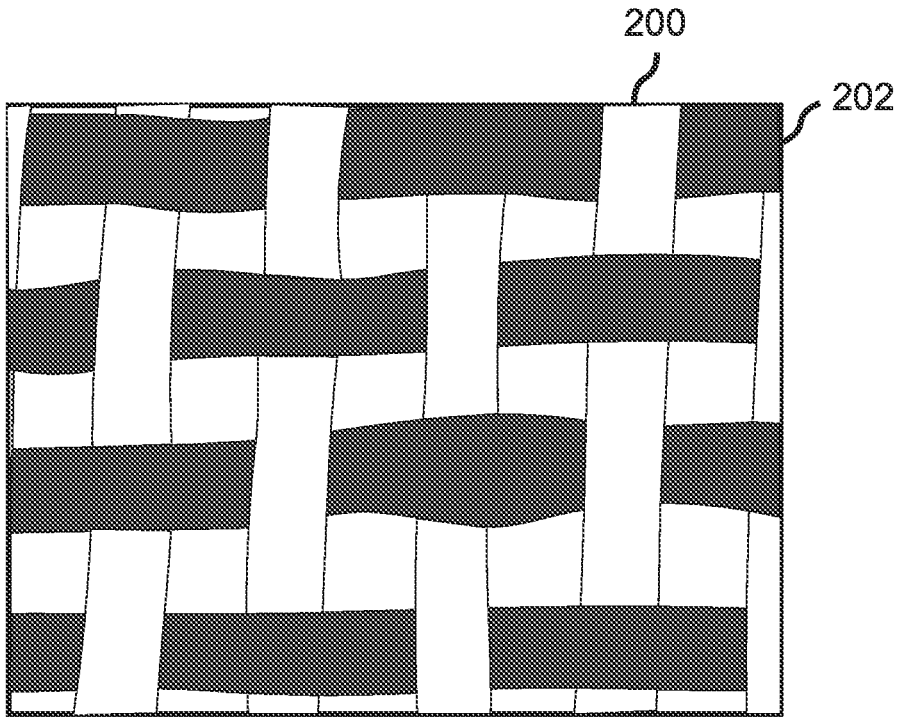
FIG. 2 illustrates a micrograph of an open weave mesh fabric layer of TVA panel in an embodiment of the present invention.

With reference to FIG. 2, the plain weave or warp knit fabric in various embodiments is very open, having for example 15 ends-per-inch (epi) in both the machine 200 and cross-machine 202 directions. This results in a textile with an open area of greater that 25% based on the surface area of the textile.

The open area of the textile mesh layers 102, 104 is critical to providing thermal vent performance for cooling the user. In various embodiments the open structure of the fabric is stabilized so as to prevent fiber shift, provide for stitch holding, and offer optimized ballistic performance and limited yarn pull-out. In some embodiments leno looper constructions are woven, whereby both the main fiber and the nylon looper yarn weave or cross. These embodiments offer all of the above benefits, but with the drawback of being somewhat complex.

Warp knits do not weave the main fiber, and this can result in yarn pullout. The use of either of the looped constructions adds to the stability of the construction, and permits more open constructions to be achieved with adequate resistance to fiber shift. In some embodiments, the plain weave has enough stability to permit off-loom (after removal from the loom) stabilization of the fiber and yarn, and their intersections, using pigmented coatings. This approach is preferred for some applications over looper constructions, because in many applications that use para aramid fiber the fiber must be protected from UV degradation by a pigment coating. In addition, in many applications the garment must have a color or camouflage pattern to match the rest of the user's uniform. However, when highly aggressive thermal requirements must be met, woven looper constructions are sometimes preferred because they can provide higher open areas in the construction, and therefore provide for higher heat transfer rates. It should be noted, however, that as mesh size increases, the protection performance for smaller projectiles decreases.

In some embodiments the interstice size of the mesh is smaller than a US Army 16-grain Right Round Cylinder ("RRC") Fragment Simulating Projectile ("FSP") fragment with an area of approximately 0.028 $in^2$. This small interstice size allows the mesh to stop stones and debris from IED's and larger fragmentation rather than allowing them to pass through, thereby improving the ballistic performance of the invention. For some applications this approach provides the greatest combined performance of the Outer Shell Layer and the Inner Liner Layer of the Thermally Vented Armor ("TVA") panels as they work together with the protective cards to stop a projectile. This combined performance is necessary for some applications, because larger projectiles are necessarily more massive and can deliver more energy than less massive projectiles. In addition to a small weave mesh opening size, in various embodiments a mesh coating with a pigmented, flame retardant urethane improves the large fiber stability and enhances ballistic performance. This coating for some embodiments weighs approximately 2.5 oz/yd2 and locks the fiber intersections of the open mesh TVA panel layers.

When small 2-4 grain fragments, soil or small stone projectiles are considered, the protective solution of the present invention is distinct from the combined protection described above. These small projectiles are less massive, and as a result have small cross sections. If the mesh layers are constructed to engage these small projectiles then the thermal performance of the TVA panels will be compromised. Instead, in various embodiments of the present invention small fragments are stopped by the protective cards alone, without any interaction with the mesh layers.

This separation of protective performance is an important and novel aspect of the present invention. In the case of large, high energy projectiles, all the fiber mass of the TVA layers contributes to stopping the ballistic threat. These large projectiles do not require restriction of the heat transfer through the use of excessively small mesh openings. The invention of a separate card layer that offers heat transfer open area in a piece-wise fashion permits protection from the smaller set of projectiles. The mesh openings are not small enough to stop these threats. However the protective card layer can be optimized for small projectiles, and is kept in position by the mesh layers.

The piece-wise louvered configuration of the protective cards does require some overlap of the protective cards so as to provide continuous protection. In some embodiments, this overlap is limited to 34% of the protective card area for a protective card size of 1.875×2.625 inches. For larger protective card dimensions, the percentage overlap area is lower but venting is reduced. For smaller protective card sizes the percentage of overlap area goes up, and with it the body armor system mass. However, the thermal vent area is increased. In some embodiments protective card size is maintained at approximately 1.875×2.625 inches, with some exceptions or variations at locations such as the knee and elbow where larger and smaller TVA panels are desirable for improved protection, body armor system flexibility, and control of assembly cost.

Figure 3:
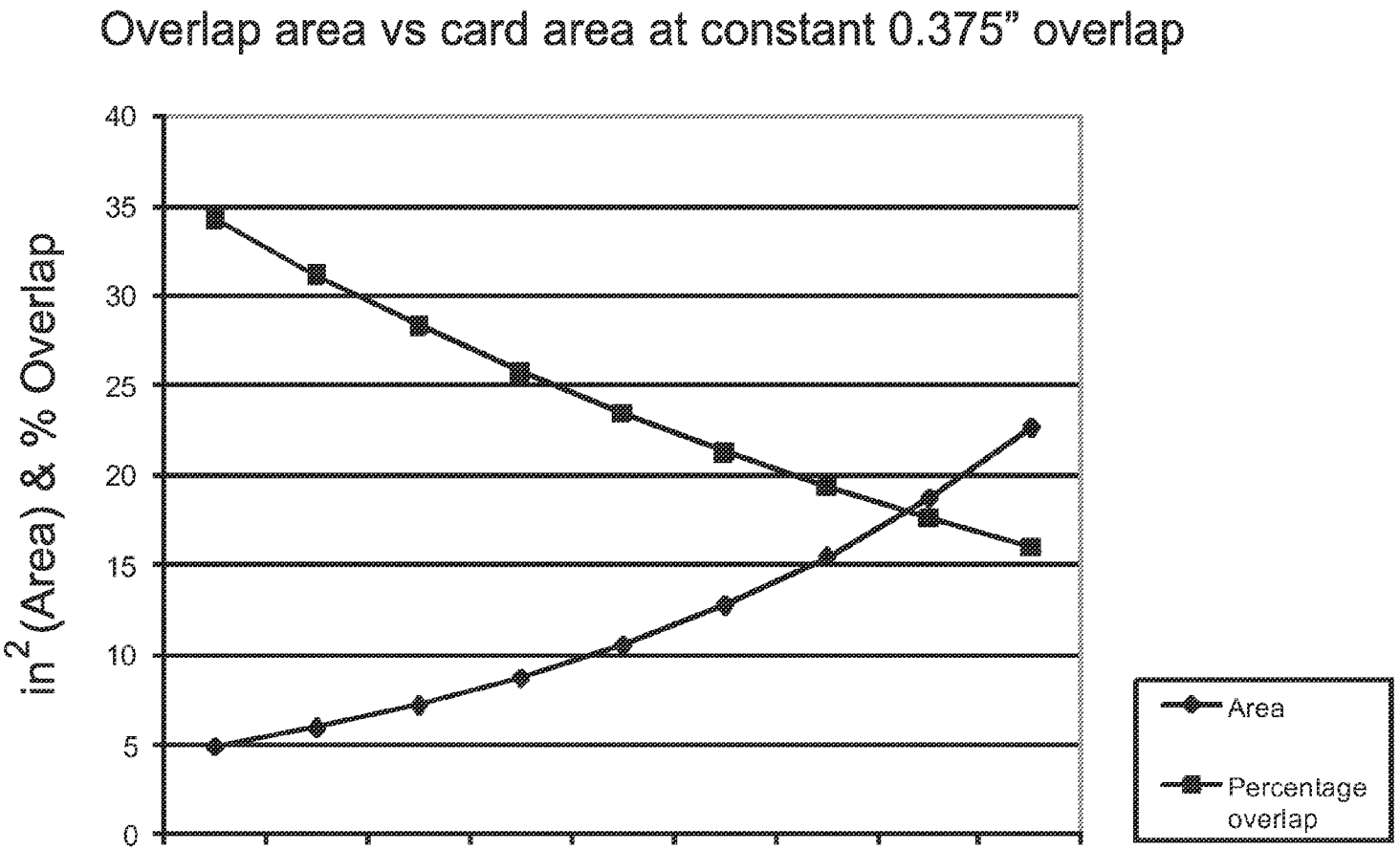
FIG. 3 is a graph illustrating protective card overlap characteristics of a TVA panel in an embodiment of the present invention.
Figure 4A:
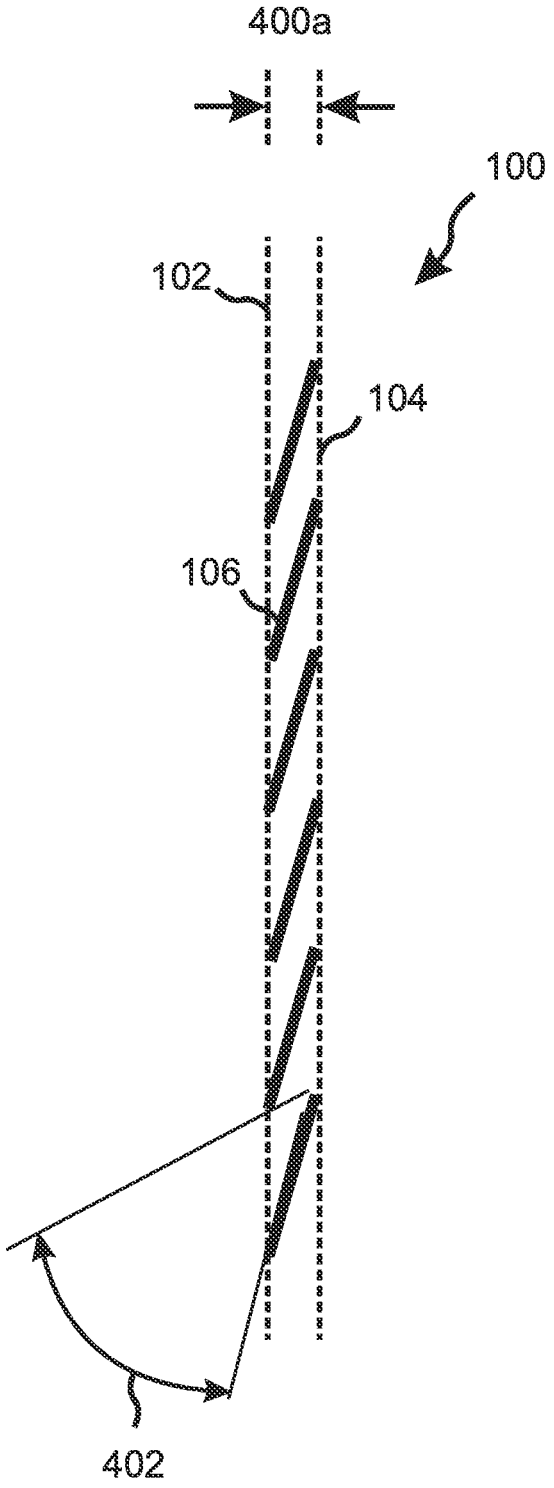
FIG. 4A is a cross-sectional illustration of a TVA panel in an embodiment of the present invention in which the apparent direction of vulnerability of the TVA panel is from below.
Figure 4B:
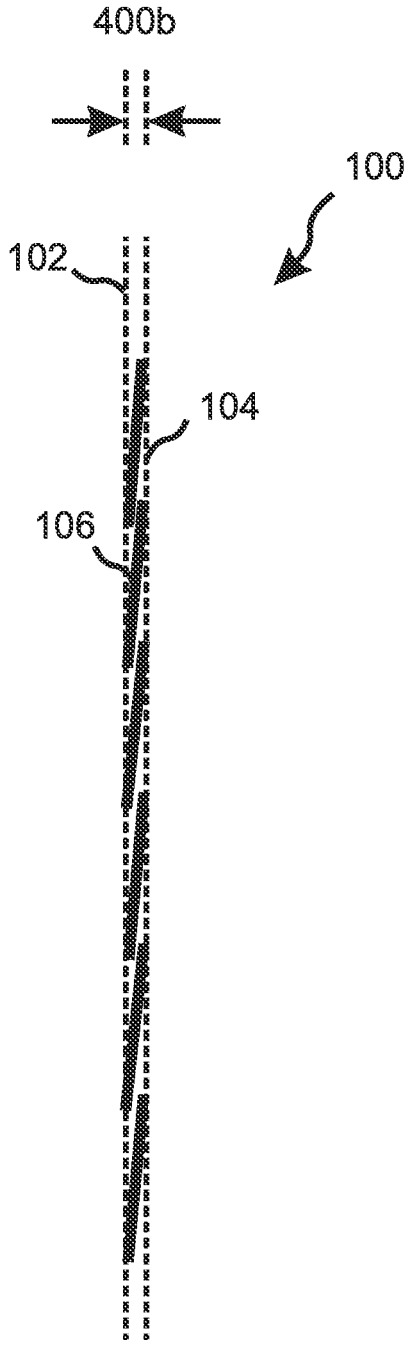
FIG. 4B is an cross-sectional illustration of a TVA panel in an embodiment of the present invention in which the protective cards are more nearly parallel to the mesh layers than in the embodiment of FIG. 4A.
Figure 4C:
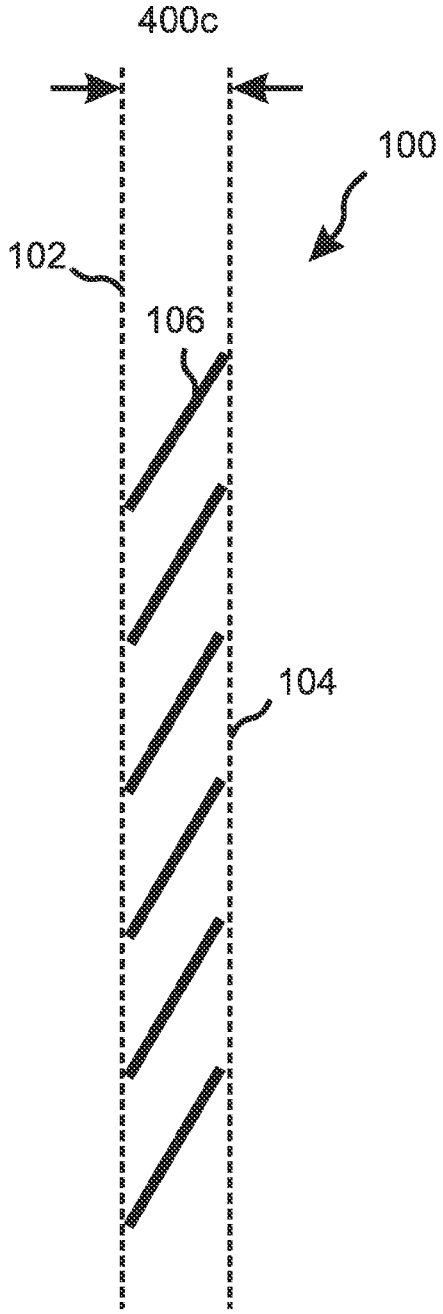
FIG. 4C is an cross-sectional illustration of a TVA panel in an embodiment of the present invention in which the protective cards are more nearly perpendicular to the mesh layers than in the embodiment of FIG. 4A.
Figure 4D:
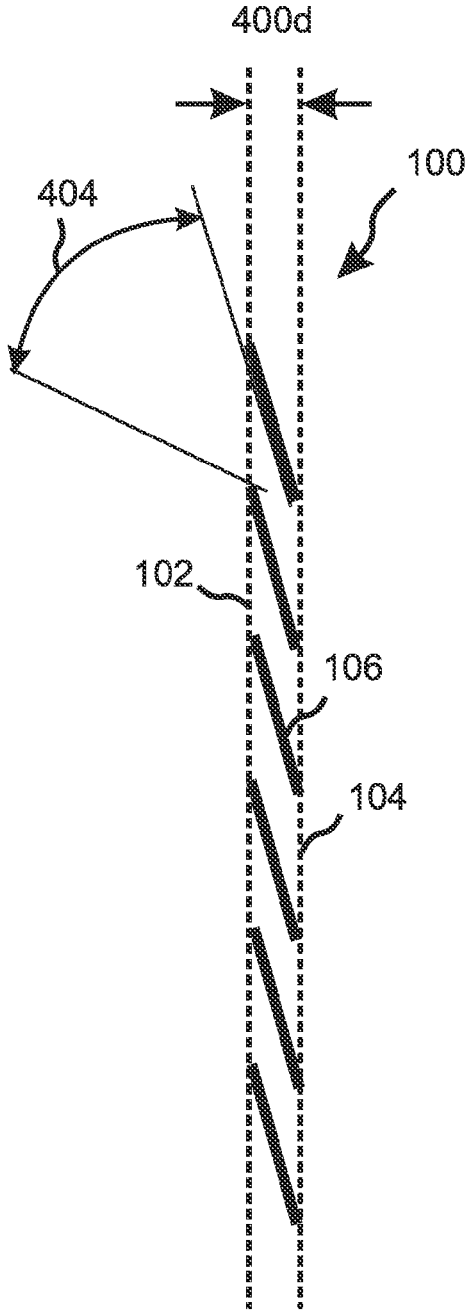
FIG. 4D is an cross-sectional illustration of a TVA panel in an embodiment of the present invention in which the apparent direction of vulnerability of the TVA panel is from above.

FIG. 3 presents data comparing overlap area (in percentage) with overall protective card area (in square inches) for a constant overlap of 0.375 inches (i.e. ⅜ inch) in various embodiments. Note that the thermally laminated and flexed UHMWPE protective cards provide protection substantially to their edges, so that the degree of card overlap is governed only by geometry considerations, and by the anticipated projectile types and approach directions.

Protective Card Layer

In various embodiments the protective cards 106 of each TVA panel 100 include layers of hot-pressed and flexed ultra-high-molecular-weight polyethylene (UHMWPE). UHMWPE provides excellent ballistic protection in a low weight system. Some embodiments provide a TVA panel weight of less than 1.25 pounds per square inch. In embodiments, the UHMWPE layers are bonded together using a hot press method, which consists of a hot cycle and cold cycle, both utilizing pressure. The UHMWPE is then flexed in various embodiments after molding, so as to form "hinge lines" that provide flexibility. (Applicant's U.S. patent application Ser. No. 12/261,211, filed Oct. 30, 2008, is hereby incorporated in its entirety by reference, for all purposes). The bonded UHMWPE cards remain rigid between the hinge lines, and thereby provide protection to their edges without any tendency to degrade or unravel at the edges. The result is protective cards that provide protection and edge-performance typical of a rigid material, while at the same time providing a flexibility that would be more typical of a "soft" woven material. In addition to non woven UHMWPE fiber in the "UniDirectional" (UD) form, hot-pressed plates of UD non-wovens made of a range of other material are used to form protective cards in various embodiments of the present invention. These include para aramid, PBO, carbon nano-tubes, and blends of these materials, which offer performance options for the hot pressed plates.

These high-pressure laminates are optimized for stopping power on small projectiles. In various embodiments, a pair of overlapping protective cards, each of which is a 3-ply UHMWPE laminate which has been bonded and flexed as described above, weighs less than 0.5 pounds per square foot and has a flex rigidity, as measured by the ASTM D 1388-07 "hanging heart" test of not more than 25,000 micro-Joules per meter, and yet is able to resist penetration by a round nose, 124 grain, 9 mm "full metal jacket" ("FMJ") projectile traveling at 1000 feet-per-second. In other embodiments, a pair of overlapping protective cards, each of which is an 8-ply UHMWPE laminate which has been bonded and flexed as described above, weighs less than 1 pound per square foot and has a flex rigidity, as measured by the ASTM D 1388-07 "hanging heart" test of not more than 50,000 micro-Joules per meter, and yet is able to resist penetration by a round nose, 124 grain, 9 mm "full metal jacket" ("FMJ") projectile traveling at 1800 feet-per-second.

In various embodiments, the card layer material is an impermeable, fully bonded, fiber mass which has no permeability to moisture or air. This is distinct from the mesh layers, which must have inherent moisture vapor and airflow permeability. This ballistic bonded laminate is excellent in general for V50 performance against a range of projectiles. In addition, it retains this stopping power for projectiles that are too small to interact with the outer and inner mesh layers.

With reference to FIG. 3, the protective cards used in certain embodiments of TVA panels are 1⅞"×2⅝" in size and layered, ⅜" over each other. The protective cards are overlapped to provide continuous protection while allowing hot and cold air to pass through, thereby keeping the user cool.

The dominate factor in heat dissipation for personnel operating in hot climates is the evaporative heat loss from the skin. Because in hot climates the ambient temperatures approach and exceed skin temperature of 35° C., there is little or no skin heat loss from radiation, conduction or convection. The ability of the human body to mange critical core body temperatures under these conditions is therefore dependant on evaporation. Using the ASTM Sweating Guarded Hot Plate methods, the Resistance to Evaporation of a Fabric (REF, $Pa \times m^2/W$) can be measured. The REF can be measured using the related "Sweating Manikin" methods. Some embodiments of the present invention provide an REF of not greater than 30. Other embodiments provide an REF of less than 15.

Air permeability is also an important feature of the present invention. Embodiments of the present invention provide an air permeability of greater than 600 $cfm/ft^2$, as measured by the ASTM D 737 Frazier method for measuring air permeability of textile fabrics.

Assembly Details

FIGS. 4A through 4D present cross-sectional views of four types of TVA panel in embodiments of the present invention. Both the inner 102 and outer 104 mesh layers are shown in the figures. However, it will be understood that in various embodiments the protective cards are not individually attached to either mesh layer 102, 104, and that in some embodiments one or both of the mesh layers is provided by an overlying or underlying mesh garment.

It can be seen from the figures that the typing angles of the protective cards 106 and the consequent spacing 400*a-d* of the inner 104 and outer 102 mesh layers controls two important factors in TVA panel performance. First, the spacing

400*a-d* of the mesh layers 102, 104 defines the open area of the venting in the card layer 106. This can be seen from the embodiments of FIGS. 4A, 4B, and 4C, as the mesh spacing 400*a-c* opens and closes the TVA panel vents.

Secondly, the tipping angle of the protective cards 106 and the consequent spacing 400*a-d* of the mesh layers 102, 104 define the opening of the cards 106 and the apparent angle of vulnerability 402, 404. It should be noted that the use of ballistic fiber in the outer mesh layer 102 limits this vulnerability considerably. This opening of the cards 106 is controlled by the design of the body armor system patterns, and is limited by the angle of vulnerability 402, 404 shown in embodiments of FIGS. 4A through 4D. This spacing 400*a-d* can be optimized according to the threat type and the anticipated angle of impact. In some applications, such as IED protection, it is anticipated that the impact angle will most frequently be from the horizontal and below, so the configuration of FIG. 4D will be most appropriate, because it orients the angle of vulnerability well above the horizontal.

More complex configurations of the protective card layer 106 are included in some embodiments, and may be required for reduction in size of the angle of vulnerability 402, 404. One such configuration includes a double layer of card elements, which may for example have oppositely oriented card layers so as to provide no net angle of vulnerability.

Figure 5A:
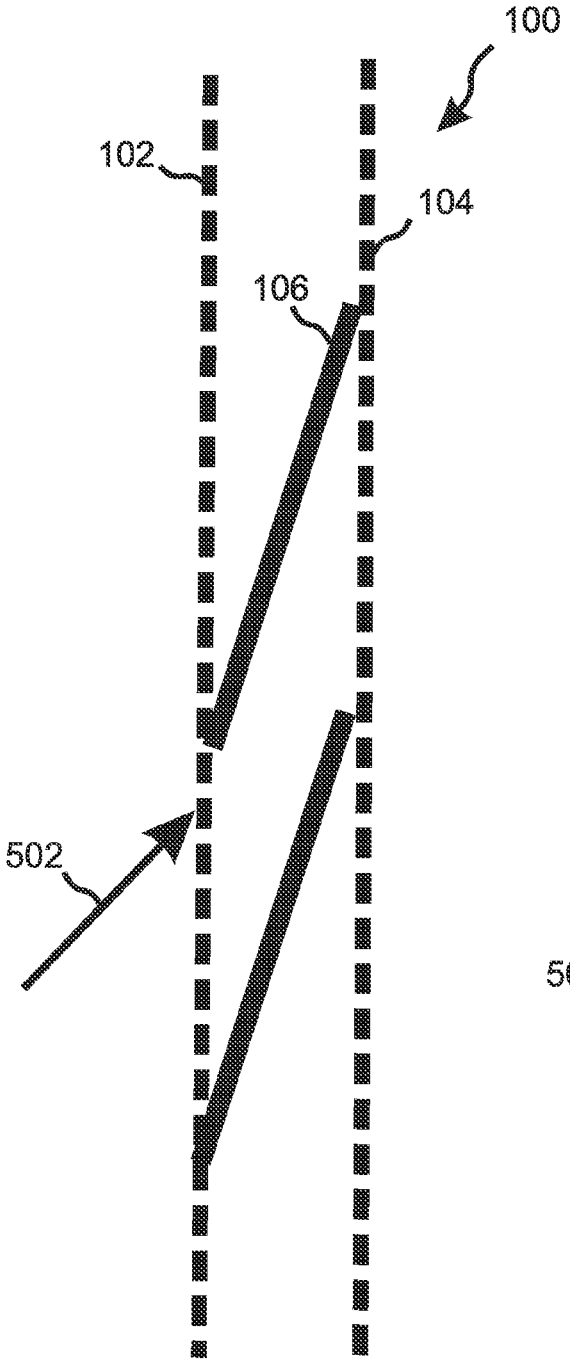
FIG. 5A is an illustration of the TVA panel of FIG. 1 showing an apparent angle of vulnerability.
Figure 5B:
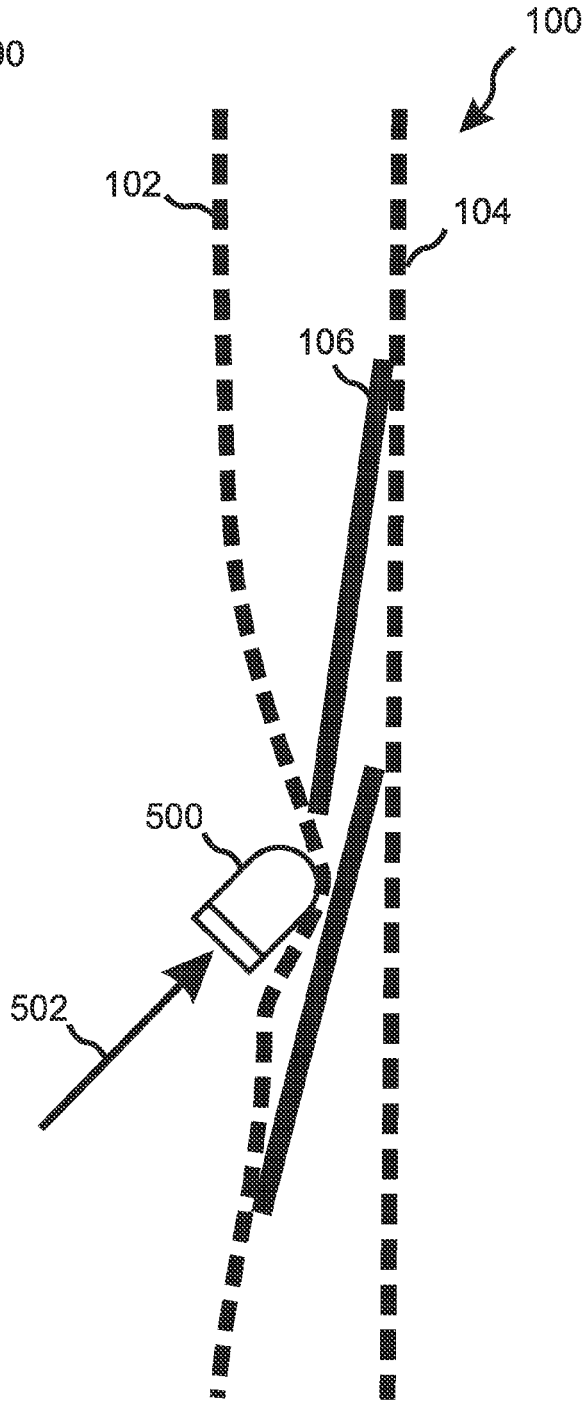
FIG. 5B illustrates the actual response of the TVA panel of FIG. 5A when struck by a projectile at the apparent angle of vulnerability.

In some embodiments each TVA panel includes a single protective card layer, and the apparent angle of vulnerability is configured away from the expected impact angles. This provides the best thermal performance at the lowest areal density. In practice, the actual degree of vulnerability is limited, as illustrated in FIGS. 5A and 5B. The outer mesh layer 102 is continuous, and as a result interacts with impacting projectiles 500 unless they are small enough to pass through the mesh. When a projectile 500 impacts in a direction 502 within the angle of vulnerability 402, 404, as long as the outer mesh 102 is engaged by the projectile 500, the structure of the inner protective card layer 106 changes shape. As can be seen in FIG. 5B, the spacing of the protective cards 106 is closed by the impact of the projectile 500, and the effective angle of vulnerability 402, 404 is thereby reduced or eliminated. This effect is enhanced in embodiments where the protective cards are flexible. Therefore, the apparent angle of vulnerability 402, 404 applies only for projectiles that are so small that they have a low probability of impacting fiber in the outer mesh layer 102.

Figure 5C:
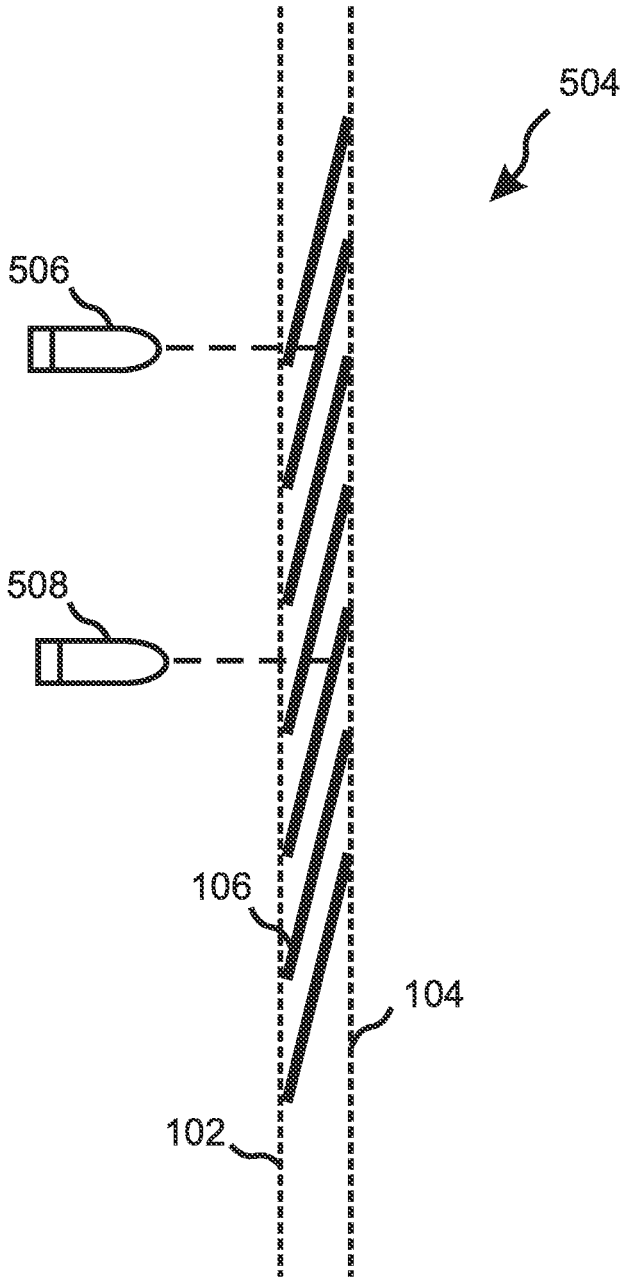
FIG. 5C illustrates a ballistic test comparing projectile penetration resistance near protective card edges with projectile penetration resistance in central regions of the protective cards.

As mentioned above, in various embodiments the protective cards included in the present invention are selected and/or configured so as to provide substantially continuous protection to their edges. However, current armor testing protocols require testing only of central regions of armor plates and assemblies, and specifically exclude testing of edge regions. FIG. 5C illustrates a testing configuration used to test edge performance of the protective cards. A TVA panel 504 according to an embodiment of the invention was constructed with 8-ply UHMWPE protective cards laminated and flexed as described above, and configured to overlap by approximately 50%.

A V50 ballistic test was performed using round nose 124 grain full-metal-jacket 9 mm bullets. Some of the bullets were directed to strike within 6 mm of protective card edges 506, and others were directed to strike at the centers of the upper halves of the protective cards 508. The bullets 506, 508 were standard National Institute of Justice ("NIJ") 9 mm FMJ projectiles. The result was that the "edge" V50 performance 506 was 1540 feet-per-second and the corresponding "baseline" V50 performance 508 was 1575 feet-per-second. The test therefore demonstrated that for this embodiment there was only a 2% difference between protection in central regions of the protective cards and protection in locations within 6 mm (i.e. less than 1 bullet diameter) from the protective card edges.

So as to simplify the terminology used to describe the relative placement of the TVA panels and the methods of joining them together, it will be assumed semantically that the panels are oriented such that the inner and outer mesh layers are vertical, and the protective cards are tipped about horizontal tipping axes away from a vertical orientation. However, it will be understood that the protective panels can, in fact, take on any desired orientation.

Using this terminology, in various embodiments, the flexibility of the TVA panels arises from several distinct features. First, the panels are highly bendable and compressible along their louvered or "vertical" directions due to the flexibility of the inner and outer mesh layers, and the freedom of adjacent protective cards to shift and slide over and past each other as the assembly is flexed and bent in that direction. This flexibility is similar to the flexibility of a typical Venetian blind, which can easily be bent, folded, and rolled in its "vertical" direction (assuming that the slats of the blind are "horizontally" configured).

In particular, the compressibility of the TVA panels is highly important to soldier mobility and flexibility. For example, it can be seen from FIG. 1A that bending of the soldier at the waste requires compression of at least the lower torso panel 14, and movement of the arms toward each other, for example to grasp a weapon, requires significant compression of the upper side panels 18. Without the easy compressibility provided by the louvered configuration of the TVA panels of the present invention, an infantry soldier would be likely for example to forego wearing the lower torso and/or upper side panels, preferring to maintain flexibility in these areas even if it meant increased exposure to projectiles.

Figure 5F:
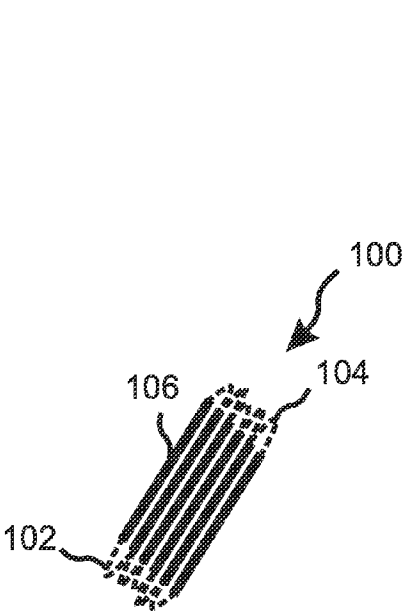
FIG. 5F is a cross-sectional illustration of the TVA panel of FIG. 5E in a fully compressed configuration due to the applied compressive force.
Figure 5E:
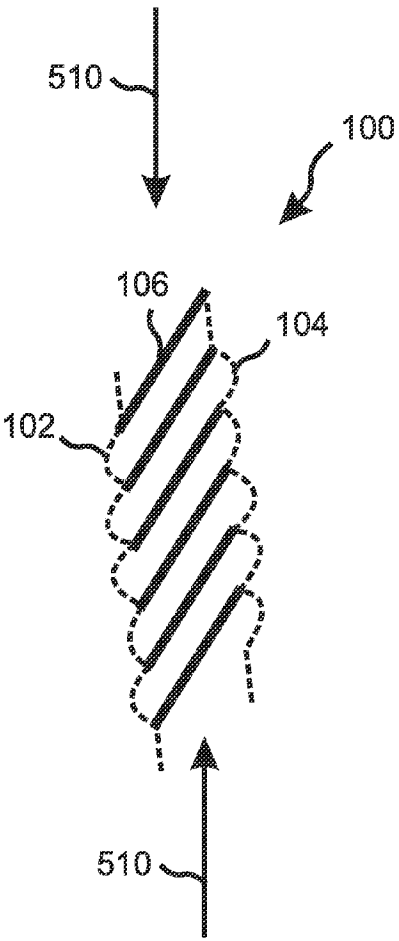
FIG. 5E is a cross-sectional illustration of the TVA panel of FIG. 5D in a partially compressed configuration due to the applied compressive force.
Figure 5D:
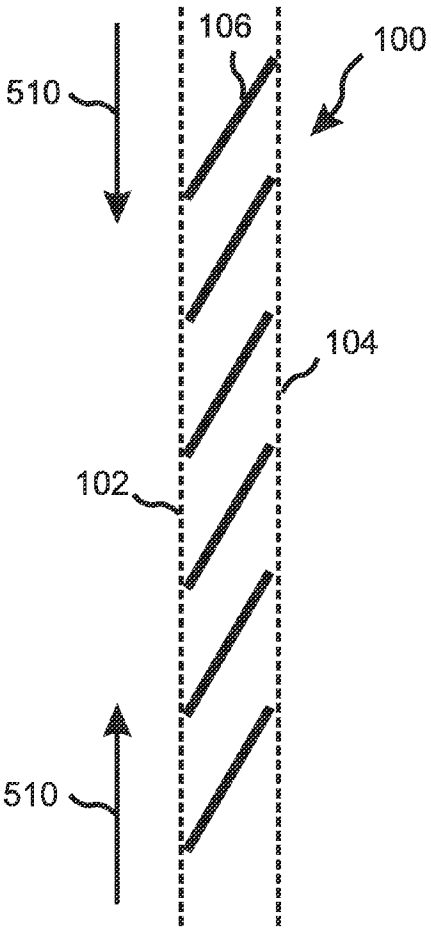
FIG. 5D is a cross-sectional illustration of the TVA panel of FIG. 4C to which a compressive force is being applied.

FIGS. 5D through 5F illustrate the compressibility of the TVA panels for an embodiment where the protective cards 106 are attached by opposing card edges to both the inner 104 and outer 102 mesh layers. With reference to FIG. 5D, application of a compressive force 510 to the TVA panel 100 causes the mesh layers 102, 104 to compress and the protective cards 106 to move toward each other and to slide relative to each other, as shown in FIG. 5E. Further compression 510 causes additional movement of the protective cards 106 toward each other, until they are fully adjacent to each other as shown in FIG. 5F.

The compressibility of the TVA panels can be expressed as a ratio of the uncompressed panel height to the fully compressed height. In certain embodiments the ratio is 3:1 and in some embodiments it is 4:1. In various embodiments, compression of the TVA panels requires very low force. This is important because soldiers must not feel constrained by their armor. Excessive compression force requirements lead to a perception of constraint, and a tendency for an armor system not to be used. In the present invention the force required to compress a TVA panel can be expressed as a force per unit of panel width perpendicular to the direction of compression. In some embodiments, the force required to fully compress a TVA panel (measured without attachment of the TVA panel to a carrier garment) is less than 0.5 lbf per inch, and in certain embodiments it is less than 0.2 lbf per inch.

Additional flexibility of the TVA assemblies in the "horizontal" direction is provided in some embodiments due to the flexibility of the protective cards themselves, such as the UHMWPE protective cards described above.

Also, the TVA assemblies can be twisted about the "vertical" axis, due to the freedom of the protective cards to separate from one another according to their relative spacing, and to rotate at least until ends of adjacent protective cards meet. This twisting ability is dependent on the widths of the protective cards, since TVA assemblies having protective cards with smaller widths can be twisted further before the ends of adjacent protective cards meet each other. The twisting flexibility is enhanced even further if the protective cards themselves are flexible.

Figure 6A:
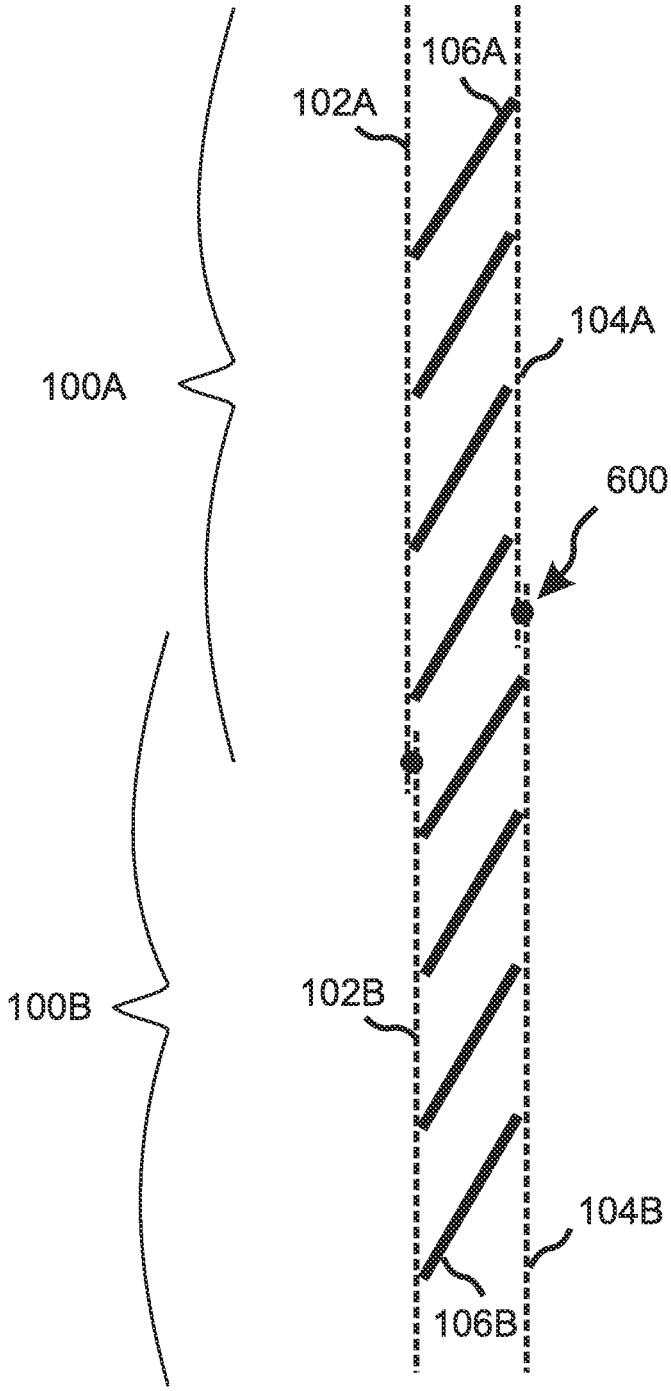
FIG. 6A is a cross-sectional illustration of two vertically adjoining TVA panels laced together so as to continue the overlapping pattern of the protective cards in each panel.
Figure 6B:
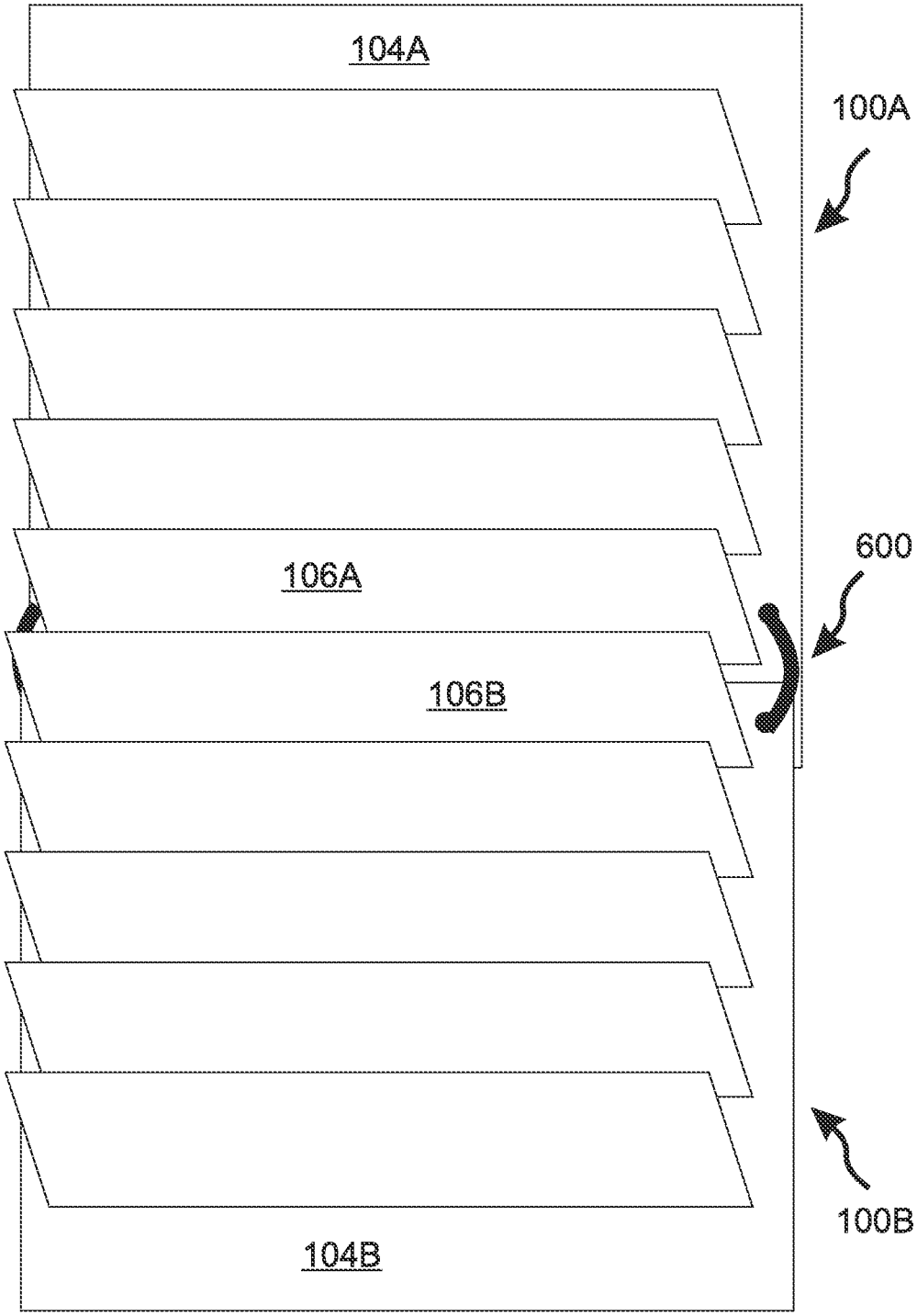
FIG. 6B is a perspective illustration of the two vertically adjoining TVA panels of FIG. 6A.

With reference to FIG. 6A and FIG. 6B, adjacent panels 100A, 100B are arranged vertically by locating them so that the "louvered" relationship between the protective cards 106A, 106B is continued from one panel 100A to the next 100B. Note that the outer mesh layer 102 has been omitted from FIG. 6B for clarity of illustration.

Figure 7A:
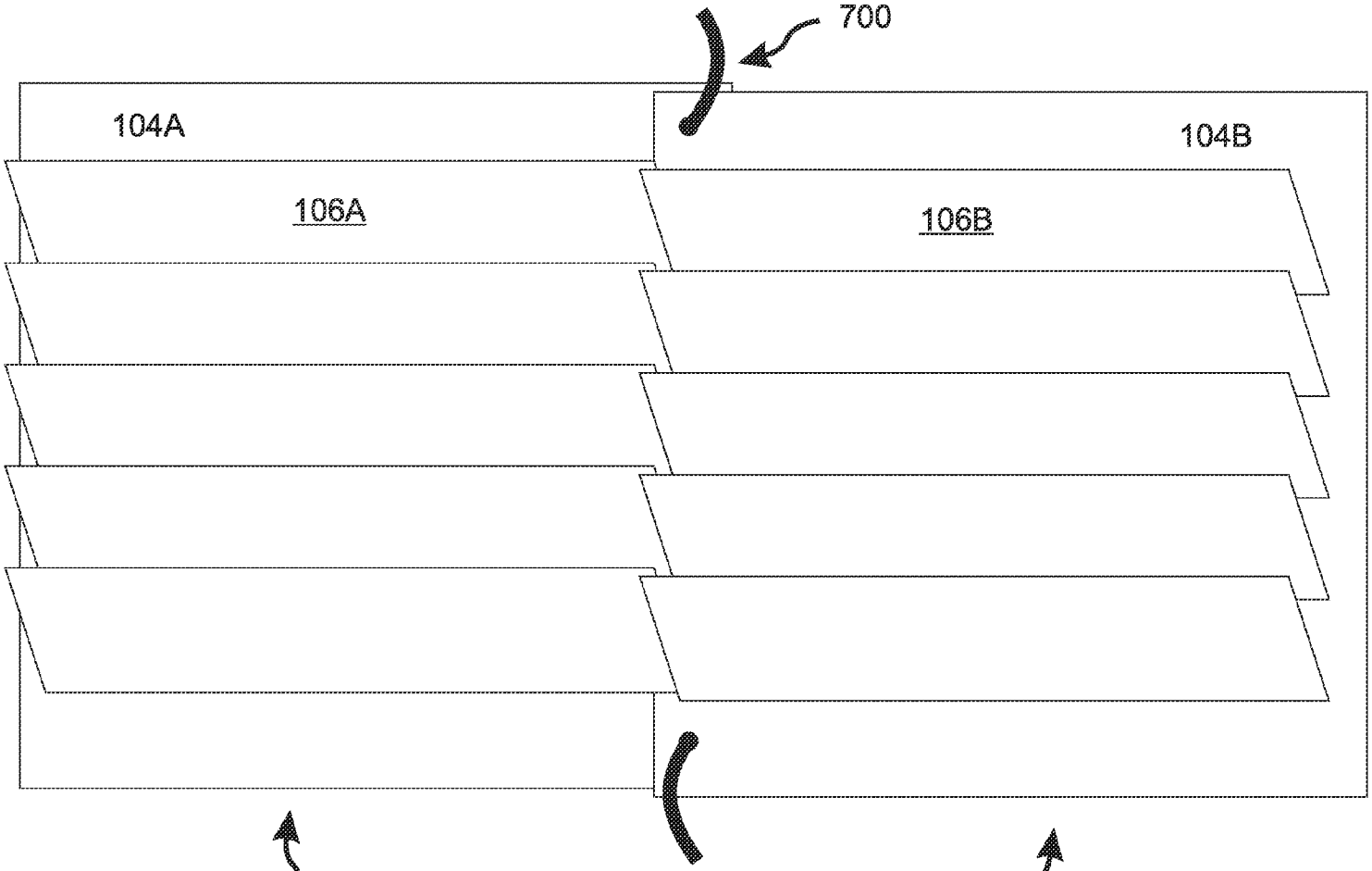
FIG. 7A is a perspective illustration of two horizontally adjoining TVA panels laced together so as to place their protective cards in slightly overlapping alignment.
Figure 7B:
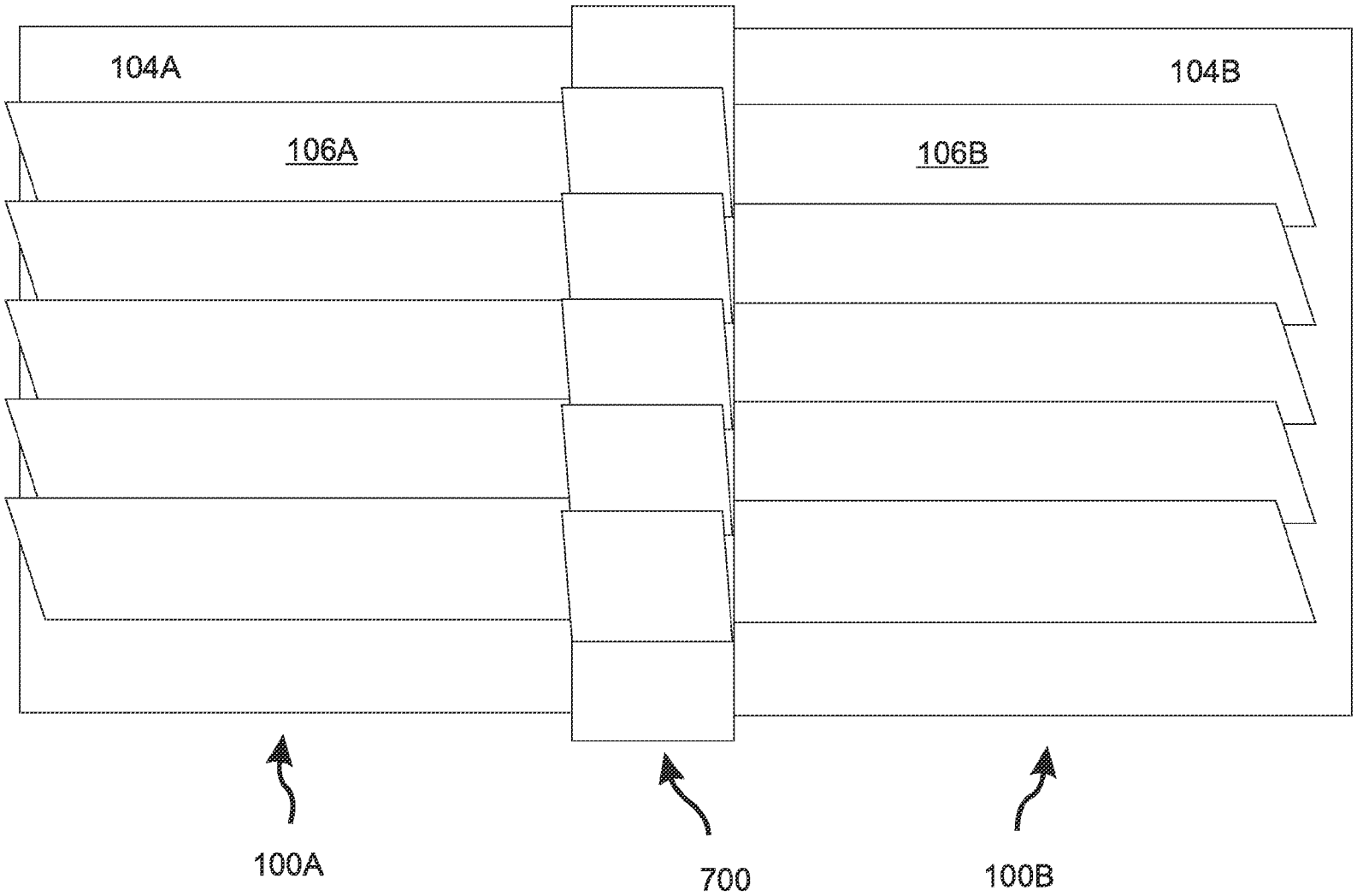
FIG. 7B is a perspective illustration of two horizontally adjoining TVA panels placed in a non overlapping alignment with a covering strip panel providing protection of the adjoining region.

With reference to FIG. 7A, in some embodiments TVA panels 100A, 100B are joined horizontally in a fixed relationship such that their protective cards 106A, 106B are aligned and slightly overlapping. In various embodiments, the inner 104A, 104B and/or outer (not shown) mesh layers are laced together 700 so as to fix the relative positioning of the adjacent panels 104A, 104B. With reference to FIG. 7B, in other embodiments greater flexibility is maintained by adjoining TVA panels 100A, 100B horizontally without overlap. In some of these embodiments, an additional strip 702 of louvered protective armor is provided so to provide protection of the adjoining region.

The flexibility of the protective cards provided in embodiments by the laminated and flexed UHMWPE material, and the consequent flexibility of the TVA panels, enables the TVA panels to be fixed in their relative horizontal positioning without resulting in unacceptable rigidity of the assembled body armor system, even in extremity regions. The overlap of the TVA panels can therefore be minimized, and hence there is minimal excess weight. Note that the outer mesh layer 102 has been omitted from FIGS. 7A and 7B for clarity of illustration.

The TVA panels 100A, 100B are fixed in position in various embodiments by attachment 600, 700 of the mesh layers 102A, 102B, 104A, 104B to each other and/or attachment of the TVA panels to a carrier garment (see item 26 in FIG. 1A) by lacing, hook-and-loop, and/or other removable means known in the art. In particular, in various embodiments one or more openable closures (see item 24 in FIG. 1A) are closed by a re-usable, openable means. The modular, detachable TVA panels thereby enable field adaptation of the body armor system to varying threats and mission needs simply by removal and/or exchange of various TVA panels. In addition, the light weight and flexibility of the TVA panels, as well as their modular assembly, enables a soldier to put on and to take off the complete body armor system, including extremity TVA panels 20, 22, without assistance.

So as to facilitate this field configurability of the body armor system, the protective cards are assembled into TVA panels by sewing and/or other mounting methods known in the art. A mounting material such as a layer of mesh textile can be used to connect the protective cards on the front and/or back face using at least a pair of textile strips and/or a complete layer of webbing, mesh, or strips on the front and/or the back of the TVA panel. These mounting textile layers can carry the hook-and-loop or other attachment mechanism used to attach the TVA panel to the inner or outer mesh layer, or to another carrier garment.

It may be interesting to compare the present invention with medieval armor, which was a modular system that provided flexible extremity protection by overlapping of rigid armor plates, which were allowed to slide across each other so as to enable flexible movement of the user. This overlapping approach significantly increased the weight of the armor, such that a user required the assistance of a squire or other attendant for putting the armor on and removing it. In comparison, in the present invention the louvered configuration of the protective cards and the light weight and flexibility of the individual UHMWPE protective cards allows the TVA panels to provide flexibility of movement, even in extremity regions, while being fixed in relationship with each other rather than being allowed to slide across each other. The result is continuous protective coverage with flexible movement and minimal wasted mass.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A thermally vented body armor system, comprising:

a plurality of thermally vented armor (TVA) panels, each TVA panel including a plurality of protective cards which, when worn by a standing user, are rotated about parallel, substantially horizontal rotational axes at a common angle and arranged in a single layer of uniformly distributed, spaced apart, mutually parallel, louvered protective cards that permits airflow between the protective cards while providing an overlapping barrier against projectile strikes in a direction normal to the protective cards, each protective card being substantially rigid over most of its area, the protective cards being separated over their entire areas by a distance that is greater than or equal to their thickness when the TVA panel is not flexed or compressed; and an inner mesh layer and an outer mesh layer, the inner and outer mesh layers having open-weave patterns that permit airflow therethrough, the TVA panels being located between the inner and outer mesh layers;

the plurality of TVA panels being assembled in substantially fixed, adjoining, relationships so as to form a protecting garment which can provide protection to a portion of a user's body against projectile penetration, TVA panels which are adjacent in a direction perpendicular to the rotational axes being positioned so as to substantially continue the louvered relationship of the protective cards.

2. The body armor system of claim 1, wherein the protective cards are attached by card edges to at least one of the inner and outer mesh layers.

3. The body armor system of claim 1, wherein each protective card is constructed so as to provide substantially uniform projectile penetration resistance over the entire area of the protective card.

4. The body armor system of claim 1, wherein TVA panels which are adjacent in a direction parallel to the rotational axes are positioned so as to substantially align their protective cards while overlapping ends thereof.

5. The body armor system of claim 1, further comprising armor junction strips which provide protection for joining regions between non-overlapping TVA panels which are adjacent in a direction parallel to the rotational axes.

6. The body armor system of claim 1, wherein at least one of the protective cards includes a plurality of layers of ultra-high-molecular-weight polyethylene (UHMWPE) which have been bonded together by a heating process and then flexed so as to enhance a flexibility thereof.

7. The body armor system of claim 1, wherein at least one of the TVA panels can be at least one of removed and exchanged by the user, so as to adapt the protecting garment to varying usage requirements.

8. The body armor system of claim 1, wherein the continuously protecting garment includes protection for at least a portion of at least one of an arm, a leg, a hand, and a foot of the user.

9. The body armor system of claim 1, wherein the TVA panels are attached to a fabric carrier garment.

10. The body armor system of claim 5, wherein the fabric carrier garment is made from at least one of Para Aramid and Vectran in a 1500 denier mesh.

11. The body armor system of claim 6, further comprising an outer mesh garment made from at least one of Para Aramid and Vectran in a 1500 denier mesh, the outer mesh garment being wearable so as to cover the TVA panels attached to the fabric carrier garment.

12. The body armor system of claim 1, wherein adjoining edges of the TVA panels are laced together so as to maintain the TVA panels in the substantially fixed, adjoining relationship.

13. The assembly of claim 1, wherein the protective cards are constructed so as to enable a pair of the overlapping protective cards to stop a round nose, 124 grain, 9 mm "full metal jacket" ("FMJ") projectile traveling at 1000 feet-per-second according to a V50 ballistic test, and so as to cause the flexural rigidity of the protective cards, as measured by the ASTM D 1388-07 hanging heart test, to be not more than 25,000 micro-Joules per meter.

14. The assembly of claim 1, wherein the protective cards are constructed so as to enable a pair of the overlapping protective cards to stop a round nose, 124 grain, 9 mm "full metal jacket" ("FMJ") projectile traveling at 1800 feet-per-second according to a V50 ballistic test, and so as to cause the flexural rigidity of the protective cards, as measured by the ASTM D 1388-07 hanging heart test, to be not more than 50,000 micro-Joules per meter.

15. The body armor system of claim 1, wherein the protective cards are constructed so as to withstand a strike without penetration by a 2, 4, 16, 64 grain fragment-simulating projectile traveling at a speed of more than 700 feet per second.

16. The body armor system of claim 1, wherein the projectile penetration resistance of the protective cards within 6 mm of the opposing edges of the cards is at least 95% of the projectile penetration resistance at the centers of the protective cards.

17. The body armor system of claim 1, wherein the TVA panels have a breathable REF of not greater than 30.

18. The body armor system of claim 1, wherein the TVA panels have a breathable REF of not greater than 15.

19. The body armor system of claim 1, wherein the continuously protecting garment weighs less than 1.25 pounds per square foot.

20. The body armor system of claim 1, wherein the outer mesh layers of at least some of the TVA panels are constructed using a protective fiber that can resist penetration, and can cause protective cards proximate a strike location to be driven closer to each other so as to intercept a projectile that would otherwise pass therebetween.

21. The body armor system of claim 1, wherein the outer mesh layers of at least some of the TVA panels are made of para aramid.

22. The body armor system of claim 1, wherein the protective cards within at least one of the TVA panels overlap by approximately ⅜ inches.

23. The body armor system of claim 1, wherein at least one of the TVA panels comprises an intermediate mesh layer and a plurality of intermediate card layers.

24. The body armor system of claim 1, wherein the TVA panels are flame resistant.

25. The body armor system of claim 1, wherein the armor system can be adapted to a usage requirement by exchanging at least one of the panels with a panel having a differing property.

26. The body armor system of claim 25, wherein the differing property is one of projectile penetration resistance, coverage area, flexibility, protective panel rotational angle, and weight.

27. The body armor system of claim 1, wherein a ratio of an uncompressed height of one of the TVA panels to a fully compressed height is at least three-to-one.

28. The body armor system of claim 1, wherein a ratio of an uncompressed height of one of the TVA panels to a fully compressed height is at least four-to-one.

29. The body armor system of claim 1, wherein a force required to fully compress one of the TVA panels in a direction perpendicular to its rotational axes, measured without attachment of the TVA panel to a garment carrier, is less than 0.5 lbf per inch of protective card width.

30. The body armor system of claim 1, wherein a force required to fully compress one of the TVA panels in a direction perpendicular to its rotational axes, measured without attachment of the TVA panel to a garment carrier, is less than 0.2 lbf per inch of protective card width.

31. The body armor system of claim 1, wherein the interstice size of the outer mesh layer is smaller than a US Army 16-grain Right Round Cylinder (RRC) Fragment Simulating Projectile ("FSP") fragment having an area of approximately 0.028 $in^2$.

32. The body armor system of claim 1, wherein the outer mesh layer is constructed using a fiber having greater than 20 grams per denier tenacity.

33. The body armor system of claim 1, wherein the outer mesh layer is constructed using a yarn having a size that is greater than 1000 denier.

34. The body armor system of claim 1, wherein the outer mesh layer is constructed using a yarn having a size that is greater than 1500 denier.

35. The body armor system of claim 1, wherein at least one of the outer and inner mesh layers has an open area of greater than 25%.

36. The body armor system of claim 1, wherein the open-weave pattern of at least one of the outer and inner mesh layers is stabilized so as to prevent fiber shifts therein.

37. The body armor system of claim 32, wherein the open-weave pattern is stabilized by an applied coating.

38. The body armor system of claim 1, wherein the outer mesh layer is coated with a pigmented, flame retardant urethane.

39. The body armor system of claim 1, wherein the outer mesh layer includes an applied pigmented coating that protects the assembly from ultraviolet exposure.

40. The body armor system of claim 1, wherein at least one of the outer and inner mesh layers is constructed using leno looper construction.

41. The body armor system of claim 1, wherein the protective cards are configured so as to orient their normal directions approximately toward an anticipated projectile approach direction.

42. The body armor system of claim 1, wherein at least one of the TVA panels comprises an intermediate mesh layer and a plurality of intermediate card layers.

43. The body armor system of claim 1, wherein the air permeability through at least one of the TVA panels and the inner and outer mesh layers is greater than 600 cfm/ft$^2$ as measured by the ASTM D 737 Frazier method for measuring air permeability of textile fabrics.

* * * * *